US011857061B2

(12) United States Patent
Gilsenan

(10) Patent No.: US 11,857,061 B2
(45) Date of Patent: Jan. 2, 2024

(54) GROOMING SYSTEM, GROOMING COLLECTION SYSTEM, GROOMING DISPOSAL SYSTEM, PORTABLE HAIR TRIMMING CATCHER SYSTEM, AND METHODS OF USE

(71) Applicant: Patrick Gilsenan, Washington, DC (US)

(72) Inventor: Patrick Gilsenan, Washington, DC (US)

( * ) Notice: Subject to any disclaimer, the term of this patent is extended or adjusted under 35 U.S.C. 154(b) by 3 days.

(21) Appl. No.: 17/589,815

(22) Filed: Jan. 31, 2022

(65) Prior Publication Data

US 2022/0240651 A1 Aug. 4, 2022

Related U.S. Application Data

(60) Provisional application No. 63/156,591, filed on Mar. 4, 2021, provisional application No. 63/145,732, filed on Feb. 4, 2021.

(51) Int. Cl.
*A45D 44/16* (2006.01)
*A45D 44/08* (2006.01)

(52) U.S. Cl.
CPC ..... *A45D 44/16* (2013.01); *A45D 44/08* (2013.01)

(58) Field of Classification Search
CPC ..... A45D 44/00; A45D 44/02; A45D 44/10; A45D 44/12; A45D 44/16; A45D 44/08; A45D 20/02; A45D 27/42; A45D 8/36; A41D 13/04; A47G 11/002; A47G 23/0608
See application file for complete search history.

(56) References Cited

U.S. PATENT DOCUMENTS 2,199,334 A * 4/1940 Ferry ..... A45D 44/08 2/50
4,114,199 A * 9/1978 Malan ..... A41B 13/103 2/49.3
4,924,527 A * 5/1990 Hintermeyer ..... A41B 13/103 2/46
5,956,763 A * 9/1999 Blackshear ..... A47G 23/0608 2/46
5,960,471 A * 10/1999 Burton ..... A41D 1/215 2/48
6,131,197 A * 10/2000 Wang ..... A45D 44/08 2/88

(Continued)

*Primary Examiner* — Cris L. Rodriguez
*Assistant Examiner* — Karim Asqiriba

(57) ABSTRACT

A grooming system, a grooming debris collection system, a grooming debris disposal system, a portable hair trimming catcher system, and methods of use are presented. The present disclosure relates generally to a grooming system for providing ease in cleaning, efficiency in grooming and debris collection, efficiency in disposal of grooming debris, and the like. More specifically, and without limitation, the disclosure provides a portable hair trimming catching device which prevents debris from falling onto the floor or other appliances and surface. The present system utilizes and moves with the user and requires no additional supports or set up such as a door or wall. In this way, the system provides for ease in set up and storage in a freestanding system. Furthermore, the system also includes a disposal system for further ease in cleaning. The present system also stows for ease in storage and for use in travel.

18 Claims, 9 Drawing Sheets

(56) References Cited

U.S. PATENT DOCUMENTS

| | | | | |
|---|---|---|---|---|
| 6,401,246 | B1 * | 6/2002 | Perez | A45D 44/08 2/50 |
| 6,496,985 | B1 * | 12/2002 | Faldet | A45D 44/08 2/46 |
| D591,484 | S * | 5/2009 | Lindh | D2/864 |
| D705,502 | S * | 5/2014 | Markfield | D30/152 |
| 10,609,970 | B2 * | 4/2020 | Alexander | B60N 2/6027 |
| D912,893 | S * | 3/2021 | Galekovic | D28/9 |
| 2005/0155129 | A1 * | 7/2005 | Hsing | A45D 44/08 2/50 |
| 2013/0086725 | A1 * | 4/2013 | Sabre | A41B 13/106 2/49.1 |
| 2013/0097762 | A1 * | 4/2013 | Park | A41D 13/1245 2/46 |
| 2017/0006935 | A1 * | 1/2017 | Viancin | A41D 13/082 |
| 2022/0095770 | A1 * | 3/2022 | Moats | A45D 44/08 |

* cited by examiner

GROOMING SYSTEM, GROOMING COLLECTION SYSTEM, GROOMING DISPOSAL SYSTEM, PORTABLE HAIR TRIMMING CATCHER SYSTEM, AND METHODS OF USE

CROSS-REFERENCE TO RELATED APPLICATIONS

The present application claims priority to U.S. Provisional Patent Application No. 63/145,732 which was filed on Feb. 4, 2021, which is hereby incorporated by reference herein in its entirety, including any figures, tables, or drawings.

The present application also claims priority to U.S. Provisional Patent Application No. 63/156,591 which was filed on Mar. 4, 2021, which is hereby incorporated by reference herein in its entirety, including any figures, tables, or drawings.

FIELD OF THE DISCLOSURE

The present disclosure relates generally to a grooming system, a grooming debris collection system, a grooming debris disposal system, a portable hair trimming catcher system, and methods of use. More specifically, and without limitation, the present disclosure is a device which aids in grooming. More specifically, and without limitation, the present disclosure includes a number of various embodiments directed toward systems which catch debris and/or hair trimmings from grooming. However, the present disclosure is not limited to these novel and inventive improvements, and it may further be adapted for a variety of purposes.

COPYRIGHT NOTICE

At least a portion of the disclosure of this patent document contains material that is subject to copyright protection. The copyright owner has no objection to the facsimile reproduction by anyone of the patent document or the patent disclosure, as it appears in the Patent and Trademark Office patent files and/or records, but otherwise reserves all copyright rights whatsoever. The following notice applies to the software and data as described below and in the drawings that form a part of this document: Copyright Patrick Gilsenan. All rights reserved.

BACKGROUND OF THE DISCLOSURE

Hair grooming is old and well known in the art. Hair grooming, or body grooming, is often the term used to refer to the removal of hair from the body. People around the world embrace body grooming as a part of the everyday routine and/or part of the regular routine. Many people routinely receive haircuts, shave legs, shave faces, and trim other hair located across the human body.

Body grooming is a matter of personal preference and typically personal choice. People have many reasons for trimming and/or grooming portions of their body ranging from health reasons, to appearance, to maintenance reasons, to comfort reasons, religious reasons, and also to help with sport and/or athletic performance. Body grooming for these purposes also comes in a variety of forms and methods including shaving—or cutting hair to the surface of the skin, clipping and/or trimming—which is done by cutting hair, oftentimes with a clipper or electric clipper.

Hair clippers or hair trimmers are a device developed and/or designed specifically to cut or trim human hair, and also animal hair. Hair trimmers are oftentimes electric and may be powered by a cord, a battery, a rechargeable battery and the like. Hair trimmers work similarly to scissors in that a hair trimmer cuts hair by sharp blades. In the case of a hair trimmer, and especially an electric hair trimmer, these sharp blades are oftentimes moving in rapid succession and often in an oscillating fashion.

Hair trimmers, whether being used on head hair or facial hair, or the like, can cut hair rapidly generating hair clippings. As barbers or cosmetologists are very familiar with, hair trimmings can accumulate rapidly and can generate a mess with their surroundings, especially when being removed or cut rapidly, as is the case with an electric trimmer. In the event of hair trimming, hair trimmings are often very small and can also fit into places that are hard to reach. This complicates grooming matters because hair trimmings are light and can float, but are small and difficult to clean up.

Facial hair trimming, in addition to head trimming can be especially difficult. Facial hair trimming is often extra messy, especially if done at home. At home, hair trimming may be done in front of a mirror, near a sink, or elsewhere where hair trimmings can generate a significant amount of mess. Those with facial hair often use a bathroom, and often use a sink to try to collect facial trimmings. Those who have tried know the difficulty of collecting hair trimmings in a sink. These messes and spreading of hair trimmings is untidy, and can take a great deal of time to clean up. Additionally, hair trimmings can cause plumbing issues when washed down a sink, a shower, a toilet or the like. For this reason, and others, collecting hair has been a long felt and challenging issue facing the art.

Drapes and/or aprons such as those found in barbershops are old and well known in the art. The drapes used in barbershops are often an efficient way to deflect hair clippings from making a mess on clothing. These aprons are imperfect in that they don't work completely and often leave hair trimmings trapped at the neck area. Additionally, these aprons are designed only to deflect hair onto the ground. These aprons are not efficient and have faced many problems in the art, and especially are of limited to no use in an at home application.

Thus, there is a need in the art which solves these and other long standing problems facing the art. There is a need in the art for a device and/or system which helps keep a space tidy, which collects hair trimmings, which can do this efficiently without malfunctioning suction cups, without leakage.

Thus, the present disclosure is directed toward providing such a solution and more. The present disclosure provides a grooming assistance device which is easy to set up and can be set up quickly and nearly instantly. Furthermore the present disclosure provides the state of the art with a fun and easy to use system which can catch hair trimmings, especially facial hair trimmings, and prevent mess without having to attach to any other surface; this feature, and others, make setup and use easier and more efficient.

Furthermore, the present disclosure is self-sustaining, providing efficiency, and making fewer steps needed to implement the present disclosure, both in setup and tear down. Furthermore, the present disclosure provides a replaceable, environmentally friendly, device for capturing clippings; especially facial clippings in the device shown. Said another way, the present disclosure provides the state of the art with an easy system for which a user can collect, dispose, and prevent mess, prevent plumbing damage, and the like as are generally caused by hair trimmings.

Thus, the present disclosure provides the state of the art with a disposal system that can catch and collect hair trimmings more easily, efficiently than the present state of the art. Furthermore, the present disclosure provides for easy setup and is fun and simple to use, compared to the state of the art and other existing devices. These and other solutions and disclosures are provided herein.

SUMMARY OF THE DISCLOSURE

The present disclosure relates generally to a grooming system, a grooming debris collection system, a grooming debris disposal system, a portable hair trimming catcher system, and methods of use. More specifically, and without limitation, the present disclosure is a device which aids in grooming. More specifically, and without limitation, the present disclosure includes a number of various embodiments directed toward systems which catch debris and/or hair trimmings from grooming.

Said another way, the present disclosure provides a beard and/or facial hair trimming assistive system. The present disclosure requires no additional elements for support or setup but is a standalone structure. In this way, the system can be easily set up by placing it over head or around neck and then simply unfolding. There is no additional setup needed or mirrors. In this way, the system moves with a user. Said another way, the system is free standing or self supporting and can be worn anywhere without additional hooks and the like.

In the arrangement shown and the system provided, the system provides for direct trimmings disposal. In other words, this makes disposal easier, cleaner and faster. The hinged folding and/or rolling design makes setup very quick and easy. Furthermore, closing the system is also very quick and easy. Furthermore, the quick and easy opening and closing methods of the system herein provide for easy storage and easy transport (such as in a travel bag).

In the arrangement presented, set up is easy and self supporting, disposal is easy and clean, and overall the system is self-supporting in a way that makes grooming far easier and more efficient, and more fun that those arrangements available in the art. Thus, the present disclosure solves a number of long felt needs in the art while providing an easy, clean method of hair trimming collection.

However, the present disclosure is not limited to these novel and inventive improvements, and it may further be adapted for a variety of purposes.

Thus, it is a primary object of the disclosure to provide a device mounting system, a securement system, a versatile action mount device, a retrofit system, and methods of use that improve upon the state of the art.

Another object of the disclosure is to provide a grooming system, a grooming debris collection system, a grooming debris disposal system, a portable hair trimming catcher system, and methods of use that are easy to use.

Yet another object of the disclosure is to provide a grooming system, a grooming debris collection system, a grooming debris disposal system, a portable hair trimming catcher system, and methods of use that can be set up quickly, relatively speaking.

Another object of the disclosure is to provide a grooming system, a grooming debris collection system, a grooming debris disposal system, a portable hair trimming catcher system, and methods of use that can be stowed away quickly, relatively speaking.

Yet another object of the disclosure is to provide a grooming system, a grooming debris collection system, a grooming debris disposal system, a portable hair trimming catcher system, and methods of use that are easy to set up.

Another object of the disclosure is to provide a grooming system, a grooming debris collection system, a grooming debris disposal system, a portable hair trimming catcher system, and methods of use that are easy to put away.

Yet another object of the disclosure is to provide a grooming system, a grooming debris collection system, a grooming debris disposal system, a portable hair trimming catcher system, and methods of use that are self supporting.

Another object of the disclosure is to provide a grooming system, a grooming debris collection system, a grooming debris disposal system, a portable hair trimming catcher system, and methods of use that catch hair trimmings.

Yet another object of the disclosure is to provide a grooming system, a grooming debris collection system, a grooming debris disposal system, a portable hair trimming catcher system, and methods of use that collects facial hair trimmings.

Another object of the disclosure is to provide a grooming system, a grooming debris collection system, a grooming debris disposal system, a portable hair trimming catcher system, and methods of use that are safe to use.

Yet another object of the disclosure is to provide a grooming system, a grooming debris collection system, a grooming debris disposal system, a portable hair trimming catcher system, and methods of use that are clean.

Another object of the disclosure is to provide a grooming system, a grooming debris collection system, a grooming debris disposal system, a portable hair trimming catcher system, and methods of use that make for easy clean up at conclusion of a grooming session or during a grooming session.

Another object of the disclosure is to provide a grooming system, a grooming debris collection system, a grooming debris disposal system, a portable hair trimming catcher system, and methods of use that provide a means of disposal.

Yet another object of the disclosure is to provide a grooming system, a grooming debris collection system, a grooming debris disposal system, a portable hair trimming catcher system, and methods of use that does not require a mirror or other item of support.

Another object of the disclosure is to provide a grooming system, a grooming debris collection system, a grooming debris disposal system, a portable hair trimming catcher system, and methods of use that are self supporting.

Yet another object of the disclosure is to provide a grooming system, a grooming debris collection system, a grooming debris disposal system, a portable hair trimming catcher system, and methods of use that roll up into an easy to store shape.

Another object of the disclosure is to provide a grooming system, a grooming debris collection system, a grooming debris disposal system, a portable hair trimming catcher system, and methods of use that folds into an easy to store shape.

Yet another object of the disclosure is to provide a grooming system, a grooming debris collection system, a grooming debris disposal system, a portable hair trimming catcher system, and methods of use that maintains support perpendicular to a human torso when engaged and in use.

Another object of the disclosure is to provide a grooming system, a grooming debris collection system, a grooming debris disposal system, a portable hair trimming catcher system, and methods of use that securely attach to a user.

Yet another object of the disclosure is to provide a grooming system, a grooming debris collection system, a grooming debris disposal system, a portable hair trimming catcher system, and methods of use that decrease the mess created by hair grooming.

Another object of the disclosure is to provide a grooming system, a grooming debris collection system, a grooming debris disposal system, a portable hair trimming catcher system, and methods of use that can be in a variety of sizes.

Yet another object of the disclosure is to provide a grooming system, a grooming debris collection system, a grooming debris disposal system, a portable hair trimming catcher system, and methods of use that are made of a durable material.

Another object of the disclosure is to provide a grooming system, a grooming debris collection system, a grooming debris disposal system, a portable hair trimming catcher system, and methods of use that are made from a moldable fabric.

Yet another object of the disclosure is to provide a grooming system, a grooming debris collection system, a grooming debris disposal system, a portable hair trimming catcher system, and methods of use that are robust.

Another object of the disclosure is to provide a grooming system, a grooming debris collection system, a grooming debris disposal system, a portable hair trimming catcher system, and methods of use that can be stored in a travel bag.

Yet another object of the disclosure is to provide a grooming system, a grooming debris collection system, a grooming debris disposal system, a portable hair trimming catcher system, and methods of use that are lightweight.

Another object of the disclosure is to provide a grooming system, a grooming debris collection system, a grooming debris disposal system, a portable hair trimming catcher system, and methods of use that straps to the neck of a user.

Yet another object of the disclosure is to provide a grooming system, a grooming debris collection system, a grooming debris disposal system, a portable hair trimming catcher system, and methods of use that contain support rods.

Another object of the disclosure is to provide a grooming system, a grooming debris collection system, a grooming debris disposal system, a portable hair trimming catcher system, and methods of use that folds open with ease.

Yet another object of the disclosure is to provide a grooming system, a grooming debris collection system, a grooming debris disposal system, a portable hair trimming catcher system, and methods of use that provide flares for additional coverage.

Another object of the disclosure is to provide a grooming system, a grooming debris collection system, a grooming debris disposal system, a portable hair trimming catcher system, and methods of use that provide a plurality of catch basin options which can also serve to add strength.

Yet another object of the disclosure is to provide a grooming system, a grooming debris collection system, a grooming debris disposal system, a portable hair trimming catcher system, and methods of use that provide for a disposal method and system as a removable feature which can hold and/or contain hair trimmings.

Another object of the disclosure is to provide a grooming system, a grooming debris collection system, a grooming debris disposal system, a portable hair trimming catcher system, and methods of use that provide a removable or flap for disposal of debris.

Yet another object of the disclosure is to provide a grooming system, a grooming debris collection system, a grooming debris disposal system, a portable hair trimming catcher system, and methods of use that provide a directed disposal means which is convenient for a user.

Another object of the disclosure is to provide a grooming system, a grooming debris collection system, a grooming debris disposal system, a portable hair trimming catcher system, and methods of use that can be cleaned by shaking.

Yet another object of the disclosure is to provide a grooming system, a grooming debris collection system, a grooming debris disposal system, a portable hair trimming catcher system, and methods of use that provide for a convenient attachment feature.

Another object of the disclosure is to provide a grooming system, a grooming debris collection system, a grooming debris disposal system, a portable hair trimming catcher system, and methods of use that provide a convenient attachment feature which secures the system close to the neck of a user without collapse.

Yet another object of the disclosure is to provide a grooming system, a grooming debris collection system, a grooming debris disposal system, a portable hair trimming catcher system, and methods of use that provide coverage for a user around the entire neck area and over the back and shoulders.

Another object of the disclosure is to provide a grooming system, a grooming debris collection system, a grooming debris disposal system, a portable hair trimming catcher system, and methods of use that provide a disposal alley which aids in collection.

Yet another object of the disclosure is to provide a grooming system, a grooming debris collection system, a grooming debris disposal system, a portable hair trimming catcher system, and methods of use that provide for additional flaps or size changes from connections.

Another object of the disclosure is to provide a grooming system, a grooming debris collection system, a grooming debris disposal system, a portable hair trimming catcher system, and methods of use that provide a plurality of support rods.

Yet another object of the disclosure is to provide a grooming system, a grooming debris collection system, a grooming debris disposal system, a portable hair trimming catcher system, and methods of use that conform to a plurality of body shapes.

Another object of the disclosure is to provide a grooming system, a grooming debris collection system, a grooming debris disposal system, a portable hair trimming catcher system, and methods of use that are reusable.

Yet another object of the disclosure is to provide a grooming system, a grooming debris collection system, a grooming debris disposal system, a portable hair trimming catcher system, and methods of use that are environmentally friendly.

Another object of the disclosure is to provide a grooming system, a grooming debris collection system, a grooming debris disposal system, a portable hair trimming catcher system, and methods of use that reduce damage to plumbing systems.

Yet another object of the disclosure is to provide a grooming system, a grooming debris collection system, a grooming debris disposal system, a portable hair trimming catcher system, and methods of use that provide for easy clean up.

Another object of the disclosure is to provide a grooming system, a grooming debris collection system, a grooming debris disposal system, a portable hair trimming catcher system, and methods of use that are simple to set up, relatively speaking.

Yet another object of the disclosure is to provide a grooming system, a grooming debris collection system, a grooming debris disposal system, a portable hair trimming catcher system, and methods of use that do not need a suction cup or other attachment and/or connections features.

Another object of the disclosure is to provide a grooming system, a grooming debris collection system, a grooming debris disposal system, a portable hair trimming catcher system, and methods of use that are self supporting structures and/or standalone structures.

Yet another object of the disclosure is to provide a grooming system, a grooming debris collection system, a grooming debris disposal system, a portable hair trimming catcher system, and methods of use that are fun.

Another object of the disclosure is to provide a grooming system, a grooming debris collection system, a grooming debris disposal system, a portable hair trimming catcher system, and methods of use that are convenient.

Yet another object of the disclosure is to provide a grooming system, a grooming debris collection system, a grooming debris disposal system, a portable hair trimming catcher system, and methods of use that are convertible.

These and other objects, features, or advantages of the present disclosure will become apparent from the specification and claims.

DETAILED DESCRIPTION OF THE DISCLOSURE

Figure 1:
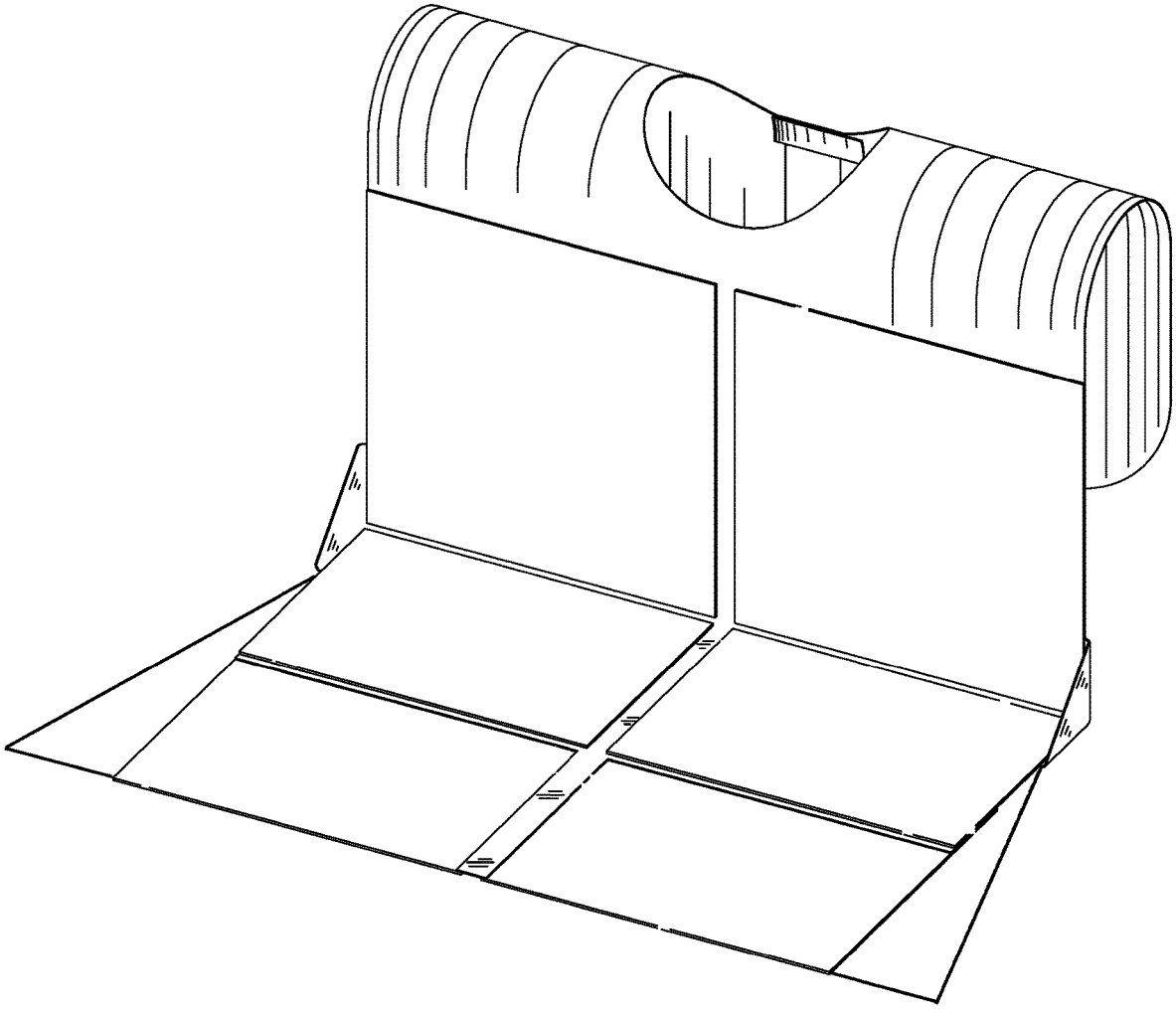
FIG. 1 is a top, perspective view of the grooming system, a grooming debris collection system, a grooming debris disposal system, a portable hair trimming catcher system; the view showing a back cover; the view showing an over shoulder feature; the view showing a neck aperture; the view showing a closure feature; the view showing a front cover; the view showing a catch feature; the view showing flare features; the view showing the system in the open position with catch feature extended; the view showing the plurality of flare features in open position with the flare features extended.
Figure 2:
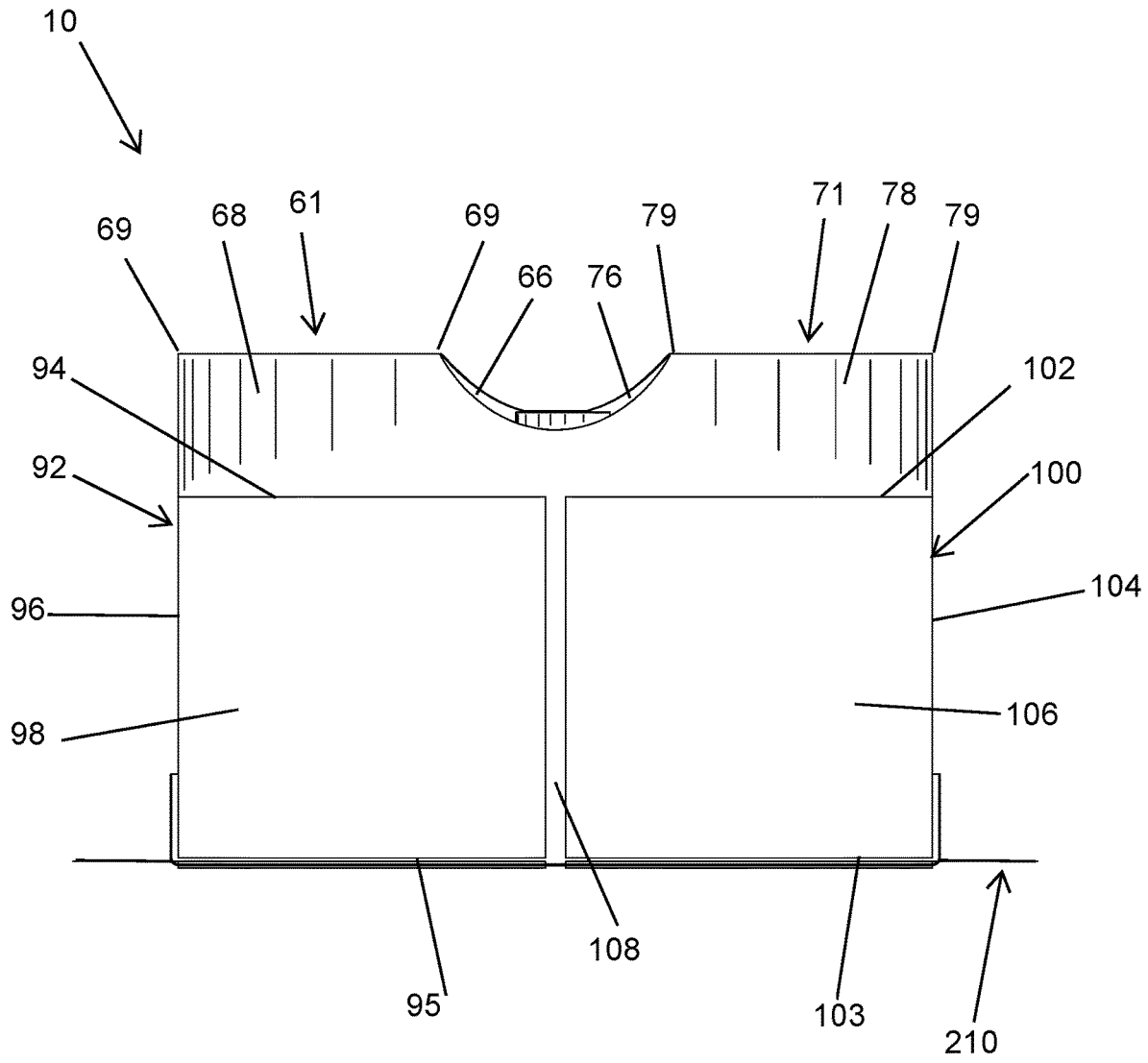
FIG. 2 is a front view of the grooming system, a grooming debris collection system, a grooming debris disposal system, a portable hair trimming catcher system; the view showing a back cover; the view showing an over shoulder feature; the view showing a neck aperture; the view showing a closure feature; the view showing a front cover; the view showing a catch feature; the view showing flare features; the view showing the system in the open position with catch feature extended; the view showing the plurality of flare features in open position with the flare features extended.
Figure 3:
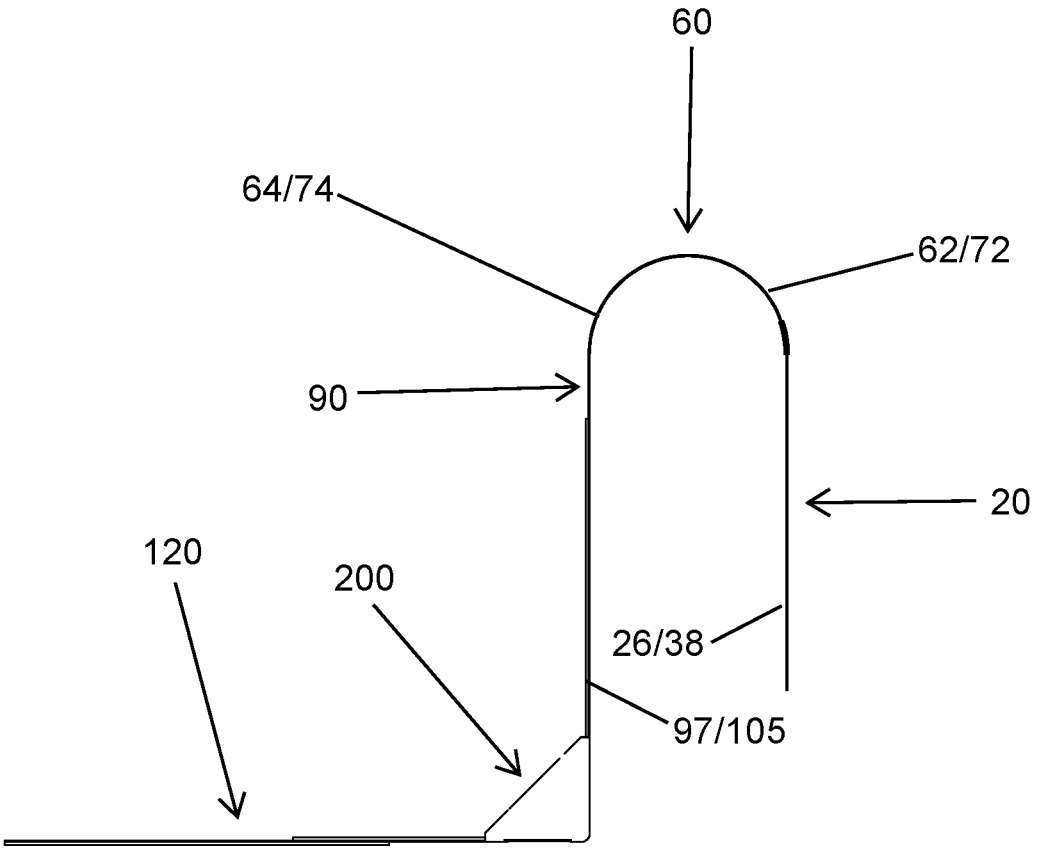
FIG. 3 is a side view of the grooming system, a grooming debris collection system, a grooming debris disposal system, a portable hair trimming catcher system; the view showing a back cover; the view showing an over shoulder feature; the view showing a neck aperture; the view showing a closure feature; the view showing a front cover; the view showing a catch feature; the view showing flare features; the view showing the system in the open position with catch feature extended; the view showing the plurality of flare features in open position with the flare features extended.
Figure 4:
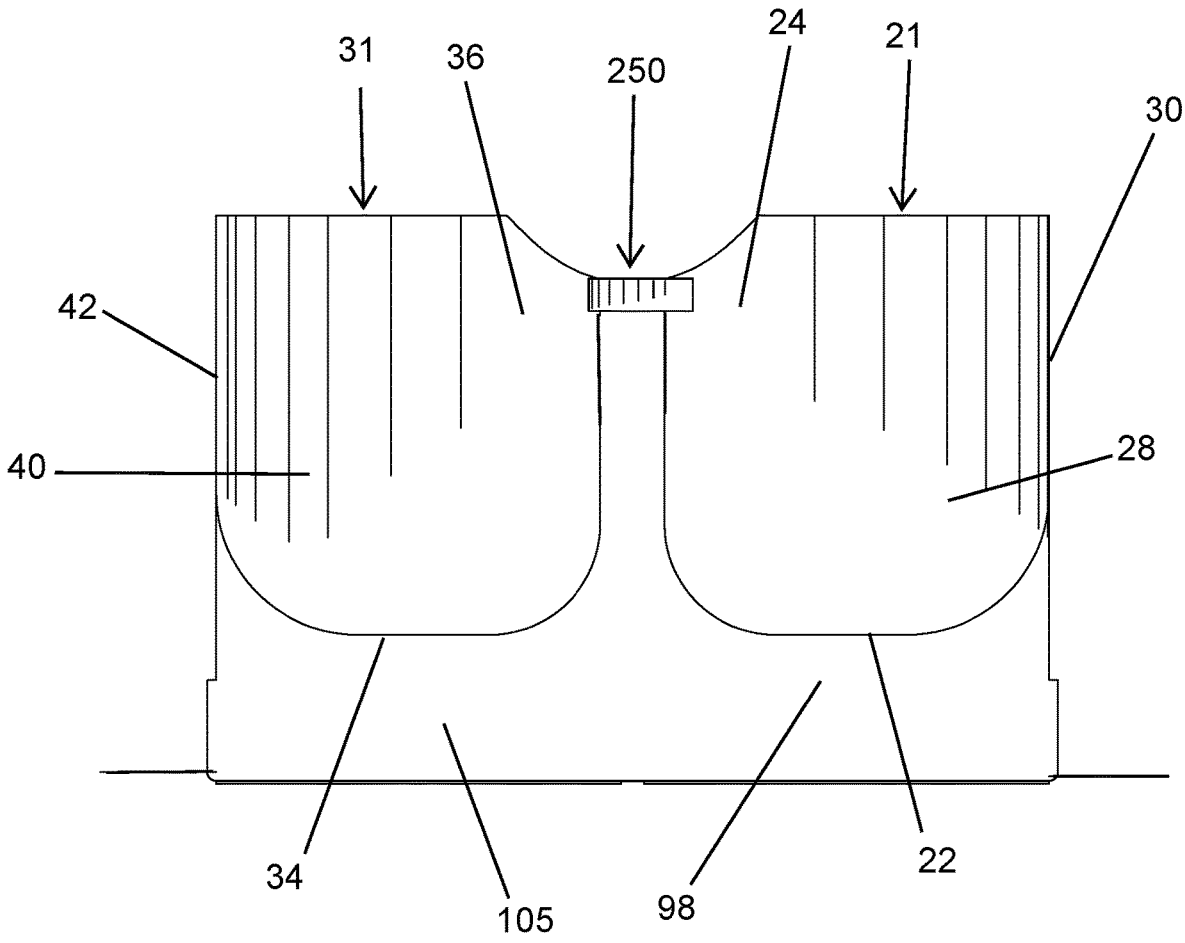
FIG. 4 is a rear view of the grooming system, a grooming debris collection system, a grooming debris disposal system, a portable hair trimming catcher system; the view showing a back cover; the view showing an over shoulder feature; the view showing a neck aperture; the view showing a closure feature; the view showing a front cover; the view showing a catch feature; the view showing flare features; the view showing the system in the open position with catch feature extended; the view showing the plurality of flare features in open position with the flare features extended.
Figure 5:
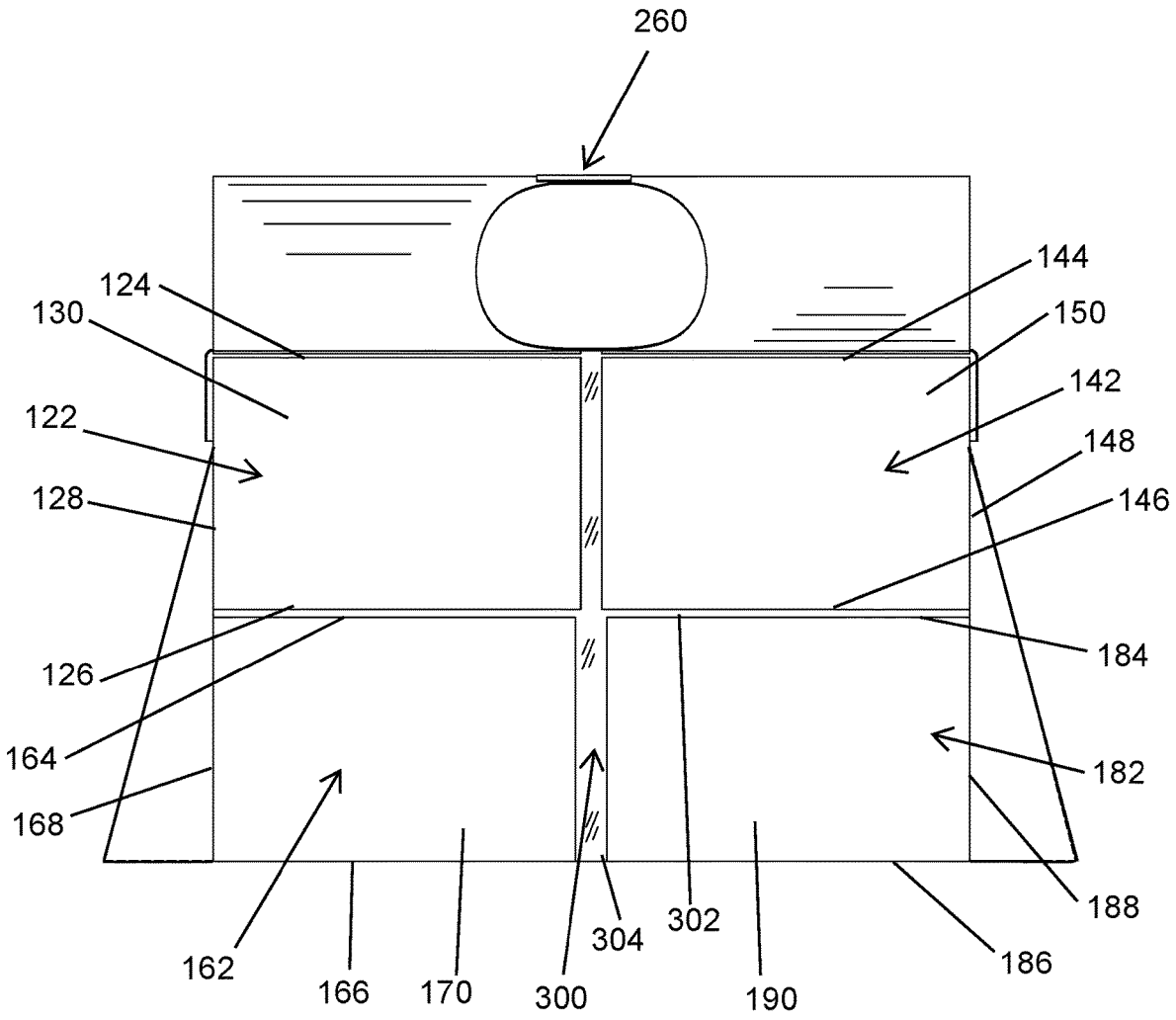
FIG. 5 is a top view of the grooming system, a grooming debris collection system, a grooming debris disposal system, a portable hair trimming catcher system; the view showing a back cover; the view showing an over shoulder feature; the view showing a neck aperture; the view showing a closure feature; the view showing a front cover; the view showing a catch feature; the view showing flare features; the view showing the system in the open position with catch feature extended; the view showing the plurality of flare features in open position with the flare features extended.
Figure 6:
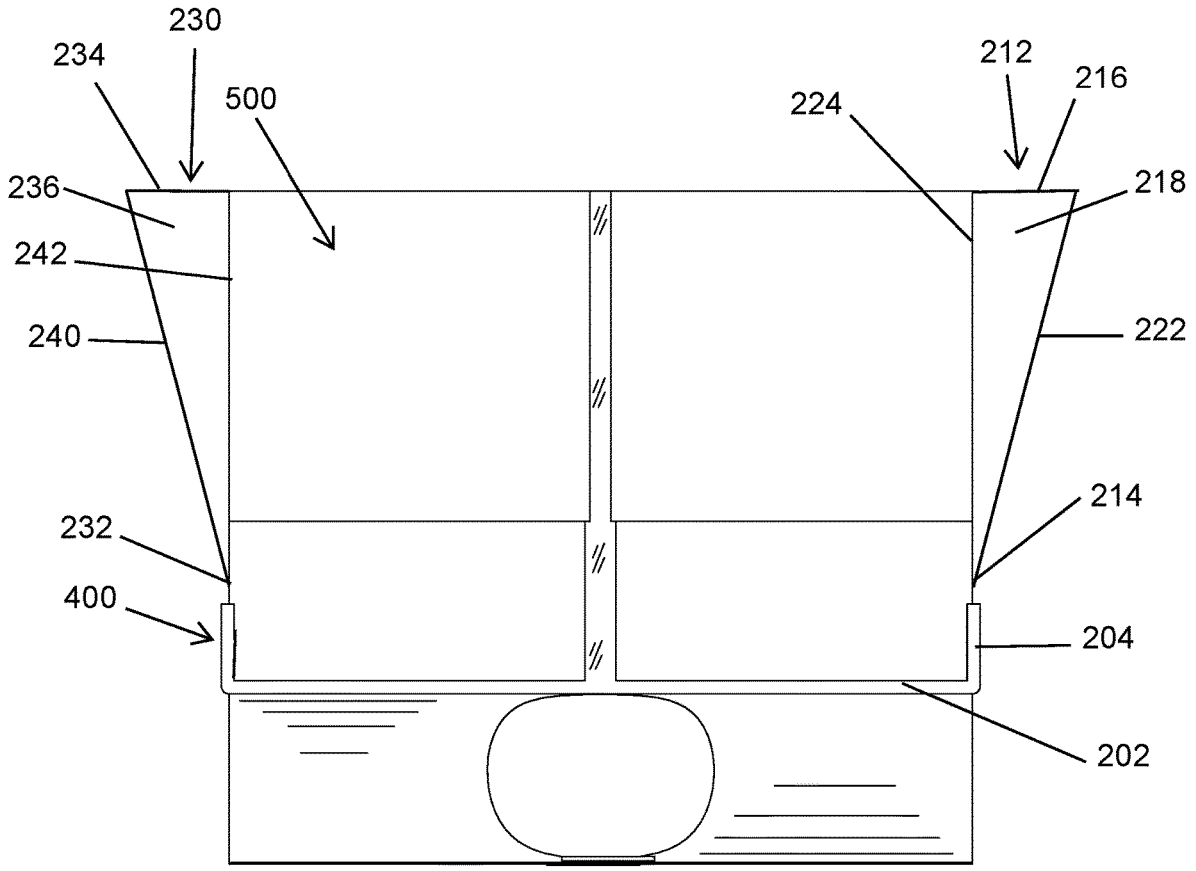
FIG. 6 is a top view of the grooming system, a grooming debris collection system, a grooming debris disposal system, a portable hair trimming catcher system; the view showing a back cover; the view showing an over shoulder feature; the view showing a neck aperture; the view showing a closure feature; the view showing a front cover; the view showing a catch feature; the view showing flare features; the view showing the system in the open position with catch feature extended; the view showing the plurality of flare features in open position with the flare features extended.
Figure 7:
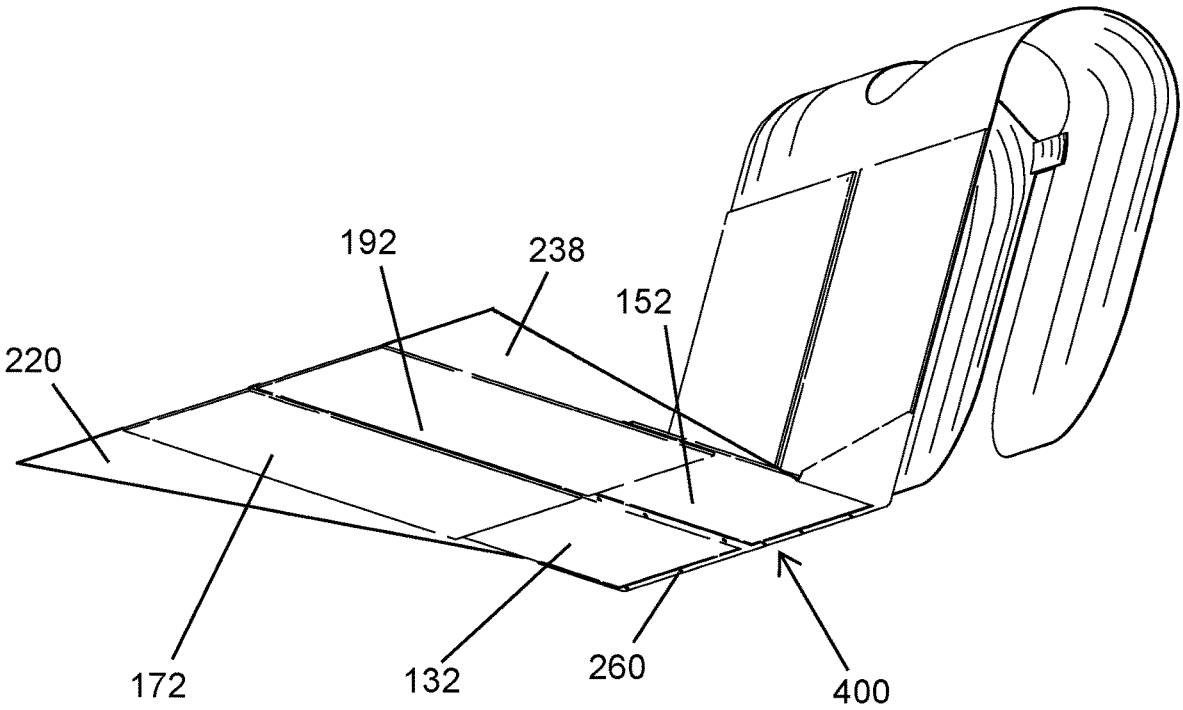
FIG. 7 is a bottom, perspective view of the grooming system, a grooming debris collection system, a grooming debris disposal system, a portable hair trimming catcher system; the view showing a back cover; the view showing an over shoulder feature; the view showing a neck aperture; the view showing a closure feature; the view showing a front cover; the view showing a catch feature; the view showing flare features; the view showing the system in the open position with catch feature extended; the view showing the plurality of flare features in open position with the flare features extended.
Figure 8:
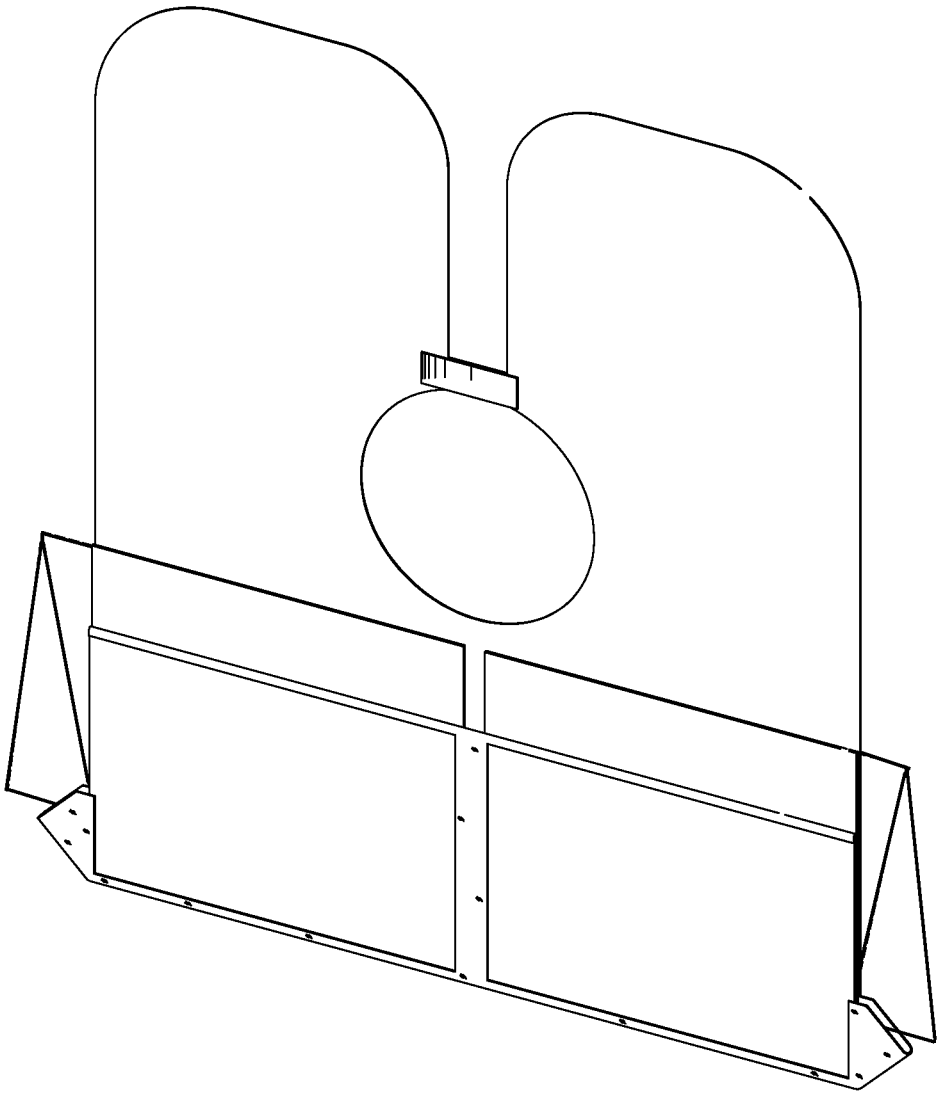
FIG. 8 is a top, perspective view of the grooming system, a grooming debris collection system, a grooming debris disposal system, a portable hair trimming catcher system; the view showing a back cover; the view showing an over shoulder feature; the view showing a neck aperture; the view showing a closure feature; the view showing a front cover; the view showing a catch feature; the view showing flare features; the view showing the system in a partially closed position with catch feature partially closed; the view showing the plurality of flare features in partially closed position with the flare features partially closed.
Figure 9:
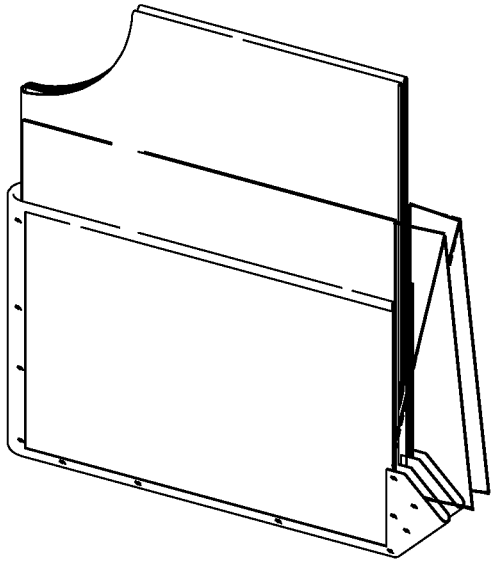
FIG. 9 is a top, perspective view of the grooming system, a grooming debris collection system, a grooming debris disposal system, a portable hair trimming catcher system; the view showing a back cover; the view showing an over shoulder feature; the view showing a neck aperture; the view showing a closure feature; the view showing a front cover; the view showing a catch feature; the view showing flare features; the view showing the system in the stored and/or closed position with catch feature closed and/or stored; the view showing the plurality of flare features in closed position with the flare features disengaged and/or stored.

In the following detailed description, reference is made to the accompanying drawings which form a part hereof, and in which is shown by way of illustration specific embodiments in which the disclosure may be practiced. These embodiments are described in sufficient detail to enable those skilled in the art to practice the disclosure, and it is to be understood that other embodiments may be utilized and that mechanical, procedural, and other changes may be made without departing from the spirit and scope of the disclosure(s). The following detailed description is, therefore, not to be taken in a limiting sense, and the scope of the disclosure(s) is defined only by the appended claims, along with the full scope of equivalents to which such claims are entitled.

As used herein, the terminology such as vertical, horizontal, top, bottom, front, back, end, sides and the like are referenced according to the views, pieces and figures presented. It should be understood, however, that the terms are used only for purposes of description, and are not intended to be used as limitations. Accordingly, orientation of an object or a combination of objects may change without departing from the scope of the disclosure.

Reference throughout this specification to "one embodiment," "an embodiment," "one example," or "an example" means that a particular feature, structure, or characteristic described in connection with the embodiment or example is included in at least one embodiment of the present disclosure. Thus, the appearance of the phrases "in one embodiment," "in an embodiment," "one example," or "an example" in various places throughout this specification are not necessarily all referring to the same embodiment or example. Furthermore, the particular features, structures, databases, or characteristics may be combined in any suitable combinations and/or sub-combinations in one or more embodiments or examples. In addition, it should be appreciated that the figures provided herewith are for explanation purposes to persons ordinarily skilled in the art and that the drawings are not necessarily drawn to scale.

All illustrations of the drawings are for the purpose of describing selected versions of the present disclosure and are not intended to limit the scope of the present disclosure.

Although the disclosure has been explained in relation to its preferred embodiment, it is to be understood that many other possible modifications and variations can be made without departing from the spirit and scope of the disclosure.

System:

With reference to the figures, a grooming system, a grooming debris collection system, a grooming debris disposal system, a portable hair trimming catcher system, and methods of use 10 are presented (also known as "grooming system", or "trimming system", or "hair trimmings system", or "hair clippings catching system", or simply "system"). Hair clippings catching system 10 is formed of any suitable size, shape and design and is configured to conveniently and easily catch hair trimmings.

In the arrangement shown, as one example, system 10 is configured as a convenient, easy to set up and easy to tear down system for catching body grooming clippings, especially facial hair clippings which are cut and/or detached during the grooming process. More specifically, but without limitation, the present disclosure provides a system which is self supporting and catches hair clippings. In the arrangement shown, a number of various embodiments are depicted which catch debris efficiently, and/or catch and collect hair trimmings which fall during the grooming process.

Said another way, the present disclosure provides a beard and/or facial hair trimming system. The present disclosure requires no additional elements for support or setup but is a standalone structure. In this way, the system can be easily set up by placing the head or around the neck and then simply unfolding. There is no additional setup needed or mirrors. In this way, the system moves with a user. Said another way, the system is free standing or self supporting and can be worn anywhere without additional hooks and the like.

In the arrangement shown and the system provided, the system provides for direct trimmings disposal. In other words, this makes disposal easier, cleaner and faster. The hinged folding and/or rolling design makes setup very quick and easy. Furthermore, closing the system is also very quick and easy. Furthermore, the quick and easy opening and closing methods of the system herein provide for easy storage and easy transport (such as in a travel bag).

In the arrangement presented, set up is easy and self supporting, disposal is easy and clean, and overall the system is self-supporting in a way that makes grooming far easier and more efficient, and more fun that those arrangements available in the art. Thus, the present disclosure solves a number of long felt needs in the art while providing an easy, clean method of hair trimming collection.

In the arrangement shown, as one example, system 10 is formed of a flexible material which is lightweight. In one embodiment, and as depicted, the present disclosure is made from a smooth and easy to wipe fabric for ease of collecting hair clippings. In this way, the hair clippings can be collected, funneled through a collection channel (to be further discussed herein), and also easily wiped away from the material. Other materials for use in the system are also hereby contemplated for use. Other material may include, but are not limited to, polyvinyl chloride, other vinyls or a combination of vinyls, mesh fabric, sheath fabric, cloth, wooden materials, polymers, enhanced polymers, an organic fabric, a rubber, a combination of cushioned materials and polymers, a combination of metals, alloys, or other lightweight materials that are easy to maneuver and easy to use and safe, or any other material or combination thereof. Furthermore, various textile materials are also hereby contemplated for use which might include a canvas, linen material, leathers—hand crafted and the like—, suede and other higher end materials. Additionally, various polymer types which maintain their structural integrity while providing a lightweight structure are also hereby contemplated for use. Furthermore, a combination of these materials is hereby contemplated for use. In the arrangement shown as one example, a textile material is combined with a polymer to form a completely smooth system which provides for varying rigidity but also for a continuous smooth surface for easy cleaning and the like.

Additionally, in the arrangement shown, as one example, system 10 is approximately rectangular and/or square in shape. However, various shapes as may be needed for efficient operation of various grooming methods and collection methods are hereby contemplated for use. Other shapes include, but are not limited to, circular shapes, triangular shapes, bowl like shapes for collection, trapezoidal like shapes which flare and/or take advantage of differentiation in collection methods, and the like.

User:

In the arrangement shown, as one example, system 10 includes user 12. User 12 is typically a user engaging with the hair trimming system 10, who is trimming head hair, facial hair, or otherwise engaging in various body grooming, or the like.

In the arrangement shown, as one example, a user 12 is an individual engaging in body grooming—whether this is hair grooming, facial hair trimming, or the like—and the user is engaging system 10 so that system 10 catches the hair and/or hair particles being clipped and/or detached. In this way, user 12 maintains clear surroundings, preventing hair trimmings from creating mess and/or causing lengthy clean up.

In the arrangement shown, as one example, user 12 is able to engage with system 10 within a matter of mere seconds. Similarly, user 12 is able to clear and/or clean system 10 within a matter of seconds. Similarly, user 12 is able to collapse and/or store system 10 within a matter of seconds.

While, generally speaking, one user is hereby contemplated for use, a plurality of users may employ and engage with system 10. In one arrangement, one user may be wearing and or covered at least partially with the system 10 while a second and/or third user 12 is engaged with the first user in a way in which the second user can provide hair clipping and/or trimming for the first user 12.

Main Body:

Back Cover:

In the arrangement shown, as one example, system 10 may also include a back cover 20. Back cover 20 (also referred to as a "rear body", a "back flaps", or simply a "back") is formed of any suitable size, shape, and design and is configured to cover the upper back portion of a user 12 with a flap or plurality of flaps that prevent hair and/or other debris from landing on the surface of a user.

Said another way, and in the arrangement shown, the back cover 20 is formed of a generally flat surface formed to lay over and/or cover a user to prevent debris from landing on the upper back and/or rear shoulders of a user 12.

In the arrangement shown, as one example, the back cover 20 is generally rectangular in shape. The back cover 20 in the arrangement shown consists of two separate panels or flaps which are generally flat and are formed to lay softly and/or with close engagement of a user 12 who is engaging with system 10. In this arrangement, and as is shown, the two flaps are also connected to an attachment feature which secures the flaps and system 10 with close or tight tolerances with the back of the neck of a user 12 so that system 10 is secure and free of loose movements.

Connection Features of the Back Cover: In the arrangement shown, as one example, back cover 20 may also include a plurality of connection features. Attachment features (also referred to as a "attachment system", a "securement feature", or simply "system securement feature") are formed of any suitable size, shape, and design and are configured to securely attach the two flaps which make up the back cover 20, in the arrangement shown. Furthermore, the connection feature is configured to provide close attachment to the back of the neck of a user 12 in such a way so that the remainder of system 10 is stable and remains in the desired position during use of system 10.

In the arrangement shown, as one example, a connection feature is formed of a hook and loop arrangement in which two straps extend horizontally from the two flaps so as to provide a means of connecting and/or securing the two flaps. Other connection features are also hereby contemplated for use. Other connection features include, but are not limited to, a draw string, a clip catch, a latch, a buckle, a button clip, a clasp, a hook and loop, and combination thereof, and the like.

In the arrangement shown, as one example, back cover 20 is formed of two flaps which are connected, removably, by the connection feature. In this way, the two flaps fall and/or drape down the back of the user 12 independently with exception of the connection feature. However, other numbers of connections features and back cover 20 arrangements are hereby contemplated for use. In one example, and as shown in one embodiment, a back cover 20 may be formed of a single, continuous piece. In this arrangement, and as is shown, the back cover 20 is formed of a single piece which extends the lack of the back of a user 12 and is connected to the shoulders (to be further discussed herein). Furthermore, the single piece may be a continuous piece forming all of system 10 (along with skeletal and/or structural and other components making up the various features and functionalities). Similarly, the back cover may be formed of three separate components, four separate components, five separate components, six separate components, and the like. In this way, the back cover may also be configured to roll and/or fold out in a stabilized fashion such as the catch extends (to be further discussed herein).

In the arrangement shown, as one example, back cover 20 includes a first shoulder cover 21—extending a length from a first end 22 to a second end 24, the first shoulder cover 21 having an interior surface 26 and an exterior surface 28, the first shoulder cover 21 extending a length between opposing sides 30 and possibly having a pocket for inserts and the like. Similarly, the first shoulder cover may have a pocket feature for holding clippers, scissors, shaving cream, oils, and/or other tools or treatments which are commonly used in body grooming and/or facial trimming.

In the arrangement shown, as one example, back cover 20 includes a second shoulder cover 31—extending a length from a first end 34 to a second end 36, the second shoulder cover 31 having an interior surface 38 and an exterior surface 40, the second shoulder cover 31 extending a length between opposing sides 42 and possibly having a pocket for inserts and the like. Similarly, the second shoulder cover 21 may have a pocket feature for holding clippers, scissors, shaving cream, oils, and/or other tools or treatments which are commonly used in body grooming and/or facial trimming. Additionally, the second shoulder cover 31 and the first shoulder cover 21 may include a connection feature, attachments to the connection feature, and a plurality of attachment features connecting the first shoulder cover 21 and the second shoulder cover 31 to system 10.

Shoulder Covers:

In the arrangement shown, as one example, system 10 may also include a plurality of over shoulder covers 60. Over should cover 60 (also referred to as a "shoulder body", a "shoulder cover", a "plurality of shoulder flaps", or simply a "shoulder flap") is formed of any suitable size, shape, and design and is configured to provide support to system 10 as well as provide covering for the shoulders so as to deflect debris and/or hair clippings from hitting and/or collecting on the shoulders of a user. Additionally, shoulder cover 60 is formed and configured to stabilize and provide support for the rest of system 10 as a connection piece and/or integrated portion of system 10.

Said another way, and in the arrangement shown, the plurality of shoulder covers 60 are formed of a generally flat surface formed to lay over and/or cover a user to prevent debris from landing on the shoulders of a user, the front shoulders of a user, upper back of a user, and/or rear shoulders of a user.

In the arrangement shown, as one example, the plurality of shoulder covers 60 is generally rectangular in shape. The shoulder cover 60 in the arrangement shown consists of two separate panels or flaps which are generally flat and are formed to lay softly on the shoulders of a user and/or with close engagement of a user who is engaging with system 10. In this arrangement, and as is shown, the two panels and/or two covers 60 are also connected to an attachment feature on the front, which secures the shoulder cover 60 with the plurality of front covers 90 (to be further discussed herein) which secures the covers and system 10 with close or tight tolerances near the front of system 10 and/or with the neck of a user so that system 10 is secure and free of loose movements. Furthermore, the two panels and/or two covers 60 are also connected to a plurality of attachment features on the rear, which secures the shoulder cover 60 with the back covers 20 (to be further discussed herein) which secures the covers and system 10 with close or tight tolerances near the rear of system 10 and/or with the neck of a user so that system 10 is secure and free of loose movements.

In the arrangement shown, as one example, the plurality of shoulder covers 60 are formed of two panels which are connected to the back cover 20 and the front cover 90, in some embodiments, removably connected. In this way, the two panels fall and/or drape over the top of the shoulders of the user independently with exception of the attachment features located at the front and rear portions of the shoulder covers 60. However, other numbers of attachment features and shoulder cover 60 arrangements are hereby contemplated for use.

In one example, and as shown in one embodiment, a shoulder cover 60 may be formed of a single, continuous piece more circular, which encircles the neck, or the like. In this arrangement, and as one example of an embodiment of the disclosure, the shoulder cover 60 is formed of a single piece which extends around the back of a user and is connected to the back cover 20 and the front cover 90 (to be further discussed herein). Furthermore, the single piece may be a continuous piece forming all of system 10 (along with skeletal and/or structural and other components making up the various features and functionalities). Similarly, the shoulder covers 60 may be formed of three separate components, four separate components, five separate components, six separate components, and the like. In this way, the plurality of shoulder covers 60 may also be configured to roll and/or fold out in a stabilized fashion such as the catch extends (to be further discussed herein).

In the arrangement shown, as one example, the plurality of shoulder covers 60 includes a first shoulder cover 61—extending a length from a first end 62 to a second end 64, the first shoulder cover 61 having an interior surface 66 and an exterior surface 68, the first shoulder cover 61 extending a length between opposing sides 69 and possibly having a pocket for inserts and the like. Similarly, the first shoulder cover may have a pocket feature for holding clippers, scissors, shaving cream, oils, and/or other tools or treatments which are commonly used in body grooming and/or facial trimming.

In the arrangement shown, as one example, the plurality of shoulder covers 60 includes a second shoulder cover 71—extending a length from a first end 72 to a second end 74, the second shoulder cover 71 having an interior surface 76 and an exterior surface 78, the second shoulder cover 71 extending a length between opposing sides 79 and possibly having a pocket for inserts and the like. Similarly, the second shoulder cover 71 may have a pocket feature for holding clippers, scissors, shaving cream, oils, and/or other tools or treatments which are commonly used in body grooming and/or facial trimming. Additionally, the second shoulder cover 71 and the first shoulder cover 61 may include a plurality of attachment features, and a plurality of attachment features connecting the second shoulder cover 71 and the first shoulder cover 61 to other portions of system 10.

Front Cover:

In the arrangement shown, as one example, system 10 may also include a front cover 90. Front cover 90 (also referred to as a "front body", a "front flap", or simply a "front") is formed of any suitable size, shape, and design and is configured to provide support to system 10 as well as provide covering for the front of a user so as to deflect debris and/or hair clippings from hitting and/or collecting on the shoulders of a user. Additionally, the front cover 90 is configured to collect debris and/or collect hair trimmings, in addition to deflection and/or protection purposes. Additionally, the front cover 90 is formed and configured to stabilize and provide support for the rest of system 10, and substantially the catch feature 120 (to be further discussed herein). Furthermore, the front body 90 is configured as a connection piece and/or integrated portion of system 10. In this way, the front flap 90 connects the catch feature 120 to the plurality of shoulder covers 60.

Said another way, and in the arrangement shown, the front flap 90 is formed of a generally flat surface formed to lay over and/or cover a user to prevent debris from landing on the front of a user, and or the portion of a user which the front cover 90 is situated.

In the arrangement shown, as one example, the front cover 90 is generally rectangular in shape. The front cover 90, in the arrangement shown, consists of two separate panels or flaps, which are configured to form a single front cover 90 with an alley (to be further disclosed herein) which collects debris. Furthermore, the single panel or single surface which form the front cover 90, is generally flat and formed to lay softly on the front of a user and/or with close engagement of a user who is engaging with system 10.

In this arrangement, and as is shown, the two panels and/or two front covers 90 are also connected to an attachment feature of the catch feature 120 (to be further discussed herein), which secures the front cover 90 to the catch feature and the rest of system 10 with close or tight tolerances near the front of system 10 and/or with the neck of a user so that system 10 is secure and free of loose movements. Furthermore, the two panels and/or two front covers 90 are also connected to a plurality of attachment features on the upper portion, which secures the front cover 90 with the shoulder covers 60 (to be further discussed herein) which secures the covers and system 10 with close or tight tolerances near the rear of system 10 and/or with the neck of a user so that system 10 is secure and free of loose movements.

In the arrangement shown, as one example, the plurality of front covers 90 are formed of two panels which are connected to the shoulder cover 60 and the catch feature 120, and in some embodiments, are removably connected. In this way, the front cover 90 falls and/or drapes over the front portion or front of the user, independently with exception of the attachment features located at the top and bottom portions of the front cover 90. However, other numbers of attachment features and front cover 90 arrangements are hereby contemplated for use.

In one example, and as shown in one embodiment, front cover 90 may be formed of a single, continuous piece, which covers the front portion, or the like. In this arrangement, and as one example of an embodiment of the disclosure, the front cover 90 is formed of a single piece. Furthermore, the single piece may be a continuous piece forming all of system 10 (along with skeletal and/or structural and other components making up the various features and functionalities). Similarly, the front cover 90 may be formed of three separate components, four separate components, five separate components, six separate components, and the like. In this way, the plurality of front covers 90 may also be configured to roll and/or fold out in a stabilized fashion such as the catch extends (to be further discussed herein).

In the arrangement shown, as one example, the plurality of shoulder covers 60 includes a first panel 92—extending a length from a first end 94 to a second end 95, the first panel 92 having an interior surface 97 and an exterior surface 98, the first panel 92 extending a length between opposing sides 96 and possibly having a pocket for inserts and the like. Similarly, the first panel 92 may have a pocket feature for holding clippers, scissors, shaving cream, oils, and/or other tools or treatments which are commonly used in body grooming and/or facial trimming. Additionally, the first panel 92 and the second panel 100 may include a plurality of attachment features, and a plurality of attachment features connecting the first panel 92 and the second panel 100 to other portions of system 10.

In the arrangement shown, as one example, the plurality of shoulder covers 60 includes a second panel 100—extending a length from a first end 102 to a second end 103, the first panel 100 having an interior surface 104 and an exterior surface 105, the second panel 100 extending a length between opposing sides 104 and possibly having a pocket for inserts and the like. Similarly, the second panel 100 may have a pocket feature for holding clippers, scissors, shaving cream, oils, and/or other tools or treatments which are commonly used in body grooming and/or facial trimming. Additionally, the second panel 100 and the first panel 92 may include a plurality of attachment features, and a plurality of attachment features connecting the second panel 100 and the first panel 92 to other portions of system 10.

Additionally, and in the arrangement shown, the first panel 92 and the second panel 100 may also include a disposal alley 108 which extends between the panels, for the length of the panels, in one embodiment. The disposal alley 108 is formed of any suitable size, shape, and design and is configured as a place for debris and/or hair clippings to collect. Additionally, the disposal alley 108 is configured to channel debris and/or hair clippings collected during cleaning of system 10 and/or at times of disposal of the waster. The disposal alley 108 to be further discussed herein.

Suspension features: In the arrangement shown, front cover 90 includes suspension features. Suspension features are formed of any suitable size, shape, and design and are configured to support the catch feature 120 (to be further described herein). In this way, the suspension features allow for unfolding and/or setting up system 10. The suspension feature, in one arrangement shown, is formed of suspension wire and/or string. Other suspension features are also, hereby, contemplated for use including, but not limited to, hinges, wheels, rotating opening features, oscillating features, clamps, clips, twisting features, or other cable or structural components that allow for a hinge like support for setup and closure. The suspension features to be further discussed herein.

Attachment Features: In the arrangement shown, as one example, various components of system 10 are attached to other components. Various types of attachments may be used including but not limited to unitary construction, stitching, extrusion, and other attachments. Attachment features to be further discussed herein.

Catch Feature:

In the arrangement shown, as one example, system 10 may also include a catch feature 120. Catch feature 120 (also referred to as a "lower body", a "foldout", or simply a "catch") is formed of any suitable size, shape, and design and is configured to provide support to system 10 as well as catch debris and other hair clippings and the like.

Additionally, the catch feature 120 is configured to collect debris and/or collect hair trimmings, in addition to deflection and/or protection purposes. Additionally, the catch feature 120 is formed and configured to stabilize and provide support for the rest of system 10, and substantially the catch feature 120 (to be further discussed herein). Catch feature 120 is self supporting with the other features and components disclosed herein, and may be self supporting in a variety of methods as are disclosed herein.

Said another way, and in the arrangement shown, the front flap 90 is formed of a generally flat surface formed to sit flat below where a user is engaging in body grooming and/or where a user is trimming facial hair. In this way, the catch feature 120 catches falling debris and/or hair trimmings and prevents these hair trimmings from falling on undesired surfaces and/or from landing on the front of a user, and or the portion of a user which the catch feature 120 is nearby.

In the arrangement shown, as one example, the catch feature 120 is generally rectangular in shape. The catch feature 120, in the arrangement shown, consists of a plurality of separate panels or flaps, which are configured to form a single catch feature 120 along with a plurality of disposal alleys (to be further disclosed herein) which collects debris and/or hair trimmings. Furthermore, the plurality of panels or plurality of surfaces which form the catch feature 120, are generally flat but may also be bowl-like in shape or concave when viewed from the top, when the system is in an open position.

In this arrangement, and as is shown, the plurality of panels and/or plurality of catch features 120 are also connected to an attachment feature of the front cover 90, which serves to connect the catch feature and the rest of system 10 with close or tight tolerances near the front of system 10. Additionally, the catch feature 120 may be connected and/or suspended from the front cover 90 by a plurality of suspension features. Furthermore, the plurality of catch panels and/or the catch feature 120 are also connected to a plurality of attachment features on the inner portion, which secures the catch feature 120 with the front cover 90 (to be further discussed herein) which secures the covers and system 10 with close or tight tolerances near the rear of system 10.

In the arrangement shown, as one example, the plurality of catch features 120 are formed of four panels which are connected to one another via intersecting disposal alleys (to be further discussed herein), and in some embodiments, are removably connected. In this way, the catch features 120 floats and/or drapes perpendicularly to a user 12 when the user 12 is standing. In this way, the front portion or front of the user 12, independently with exception of the attachment features, located at the top and bottom portions of the catch feature 120 is protected and/or covered. However, other numbers of attachment features and catch feature 120 arrangements are hereby contemplated for use.

In one example, and as shown in one embodiment, catch feature 120 may be formed of a single, continuous piece, which covers the front portion, or the like. In this arrangement, and as one example of an embodiment of the disclosure, the catch feature 120 is formed of a single piece. Furthermore, the single piece may be a continuous piece forming all of system 10 (along with skeletal and/or structural and other components making up the various features and functionalities). Similarly, the catch feature 120 may be formed of two separate components, three separate components, four separate components, five separate components, six separate components, seven separate components, eight separate components, nine separate components, or more, and the like. In this way, the catch feature 120 may also be configured to roll and/or fold out in a stabilized fashion such as the catch extending outward from the front cover 90.

In the arrangement shown, as one example, the catch feature 120 includes a first panel 122—extending a length from a first end 124 to a second end 126, the first panel 122 extending a length between opposing sides 128 and possibly having a pocket for inserts and the like, the first panel 122 having a top surface 130 and a bottom surface 132.

Similarly, the first panel 122 may have a pocket feature for holding clippers, scissors, shaving cream, oils, and/or other tools or treatments which are commonly used in body grooming and/or facial trimming. Additionally, the first panel 122 has a plurality of attachment features connecting the first panel 122 to other portions of system 10 including but not limited to the front cover 90, other panels making up the catch feature 120, the suspension features, other attachment features, a combination thereof, and the like. Additionally, the first panel 122 may also include attachment to and/or include a plurality of extension features, a plurality of disposal alleys, and a plurality of disposal traps, among other components, features, and the like.

In the arrangement shown, as one example, the catch feature may 120 include a second panel 142—extending a length from a first end 144 to a second end 146, the second panel 142 extending a length between opposing sides 148 and possibly having a pocket for inserts and the like, the second panel 142 having a top surface 150 and a bottom surface 152.

Similarly, the second panel 142 may have a pocket feature for holding clippers, scissors, shaving cream, oils, and/or other tools or treatments which are commonly used in body grooming and/or facial trimming. Additionally, the second panel 142 a plurality of attachment features connecting the second panel 142 to other portions of system 10 including but not limited to the front cover 90, other panels making up the catch feature 120, the suspension features, other attachment features, a combination thereof, and the like. Additionally, the second panel 142 may also include attachment to and/or include a plurality of extension features, a plurality of disposal alleys, and a plurality of disposal traps, among other components, features, and the like.

In the arrangement shown, as one example, the catch feature 120 may include a third panel 162—extending a length from a first end 164 to a second end 166, the third panel 162 extending a length between opposing sides 168 and possibly having a pocket for inserts and the like, the third panel 162 having a top surface 170 and a bottom surface 172.

Similarly, the third panel 162 may have a pocket feature for holding clippers, scissors, shaving cream, oils, and/or other tools or treatments which are commonly used in body grooming and/or facial trimming. Additionally, the third panel 162 a plurality of attachment features connecting the third panel 162 to other portions of system 10 including but not limited to the front cover 90, other panels making up the catch feature 120, the suspension features, other attachment features, a combination thereof, and the like. Additionally, the third panel 162 may also include attachment to and/or include a plurality of extension features, a plurality of disposal alleys, and a plurality of disposal traps, among other components, features, and the like.

In the arrangement shown, as one example, the catch feature 120 includes a fourth panel 182—extending a length from a first end 184 to a second end 186, the fourth panel 182 extending a length between opposing sides 188 and possibly having a pocket for inserts and the like, the fourth panel 182 having a top surface 190 and a bottom surface 192.

Similarly, the fourth panel 182 may have a pocket feature for holding clippers, scissors, shaving cream, oils, and/or other tools or treatments which are commonly used in body grooming and/or facial trimming. Additionally, the fourth panel 182 a plurality of attachment features connecting the fourth panel 182 to other portions of system 10 including but not limited to the front cover 90, other panels making up the catch feature 120, the suspension features, other attachment features, a combination thereof, and the like. Additionally, the fourth panel 182 may also include attachment to and/or include a plurality of extension features, a plurality of disposal alleys, and a plurality of disposal traps, among other components, features, and the like.

Suspension features: In the arrangement shown, front cover 90 and catch feature 120 includes suspension features. Suspension features are formed of any suitable size, shape, and design and are configured to support the catch feature 120, when in association with the front cover 90 or other components herein, such as the shoulder cover 60.

In this way, the suspension features allow for unfolding and/or setting up system 10. The suspension feature, in one arrangement shown, is formed of suspension wire and/or string. Other suspension features are also, hereby, contemplated for use including, but not limited to, hinges, wheels, rotating opening features, oscillating features, clamps, clips, twisting features, or other cable or structural components that allow for a hinge like support for setup and closure. The suspension features to be further discussed herein.

Attachment Features: In the arrangement shown, as one example, various components of system 10 are attached to other components. Various types of attachments may be used including but not limited to unitary construction, stitching, extrusion, and other attachments. Attachment features to be further discussed herein.

Suspension Catch Feature:

In the arrangement shown, as one example, system 10 may also include a plurality of suspension catch features 200. Suspension catch features 200 (also referred to as a "suspension catch system", a "triangle catch features", or simply a "suspension catches") are formed of any suitable size, shape, and design and are configured to provide for additional catching capabilities where the suspension feature is.

As shown in one embodiment, and particularly with reference to FIG. 31, the suspension catch feature 200 may be formed of a similar material as that of system 10 and is solid so as to be able to collect and/or catch debris and/or hair trimmings. This feature provides additional catching and/or collecting capabilities along the sides and/or outer edges of the catch feature 120 and system 10.

In the arrangement shown, as one example, suspension catch system 200 is formed of a flexible material which is lightweight. In one embodiment, and as depicted, the present disclosure is made from a smooth and easy to wipe fabric for ease of collecting hair clippings. In this way, the hair clippings can be collected, funneled through a collection channel (to be further discussed herein), and also easily wiped away from the material.

Other materials for use in the system are also hereby contemplated for use. Other material may include, but are not limited to, polyvinyl chloride, other vinyls or a combination of vinyls, mesh fabric, sheath fabric, cloth, wooden materials, polymers, enhanced polymers, an organic fabric, a rubber, a combination of cushioned materials and polymers, a combination of metals, alloys, or other lightweight materials that are easy to maneuver and easy to use and safe, or any other material or combination thereof.

Furthermore, various textile materials are also hereby contemplated for use which might include a canvas, linen material, leathers—hand crafted and the like—, suede and other higher end materials. Additionally, various polymer types which maintain their structural integrity while providing a lightweight structure are also hereby contemplated for use. Furthermore, a combination of these materials is hereby contemplated for use. In the arrangement shown as one example, a textile material is combined with a polymer to form a completely smooth system which provides for varying rigidity but also for a continuous smooth surface for easy cleaning and the like.

Additionally, in the arrangement shown, as one example, suspension catch system 200 is approximately rectangular and/or square in shape, but may present as a triangle and/or two triangles for folding and other purposes, such as maximizing collection surface area. Additionally, various shapes as may be needed for efficient operation of various grooming methods and collection methods are hereby contemplated for use. Other shapes include, but are not limited to, circular shapes, triangular shapes, bowl like shapes for collection, trapezoidal like shapes which flare and/or take advantage of differentiation in collection methods, and the like.

In the arrangement shown, suspension catch system 200 includes side attachment features 202, and triangular shaped catchers 204, among other components, features, and the like. Furthermore, suspension catch system 200 may also include additional structural components such as wire or rods, and the like.

Flare Features (Alternative Embodiment):

In an alternative embodiment, as one example, system 10 may include a plurality of pockets which are incorporated adjacent to the first panel and/or the second panel. In the arrangement shown, flare features 210 are shown. However, flare features, alternatively may not be added on, and/or flare features 210 may be replaced with pocket features for collecting debris.

In an alternative embodiment shown, as one example, system 10 may also include a plurality of flare features 210. Flare features 210 (also referred to as a "collection extension system", a "collection extension device", or simply a "flares") is formed of any suitable size, shape, and design and is configured to provide for additional catching capabilities where the suspension feature is. Said another way, the flare features are additional foldouts that can potentially be implemented to create a larger surface area for the collection of debris and/or hair trimmings that are being clipped.

As shown in one embodiment, the collection extension device 210 may be formed of a similar material as that of system 10 and is solid so as to be able to collect and/or catch debris and/or hair trimmings. This feature provides additional catching and/or collecting capabilities along the sides and/or outer edges of the collection extension device and system 10. In one arrangement, the flare features 210 are attached to the catch feature 120 and fold out or flare out. The flare features 210, in this way, are formed of a plurality of panels which may be rectangular, square, or other various shapes.

In the arrangement shown, as one example, flare features 210 are formed of a flexible material which is lightweight. In one embodiment, and as depicted, the present disclosure is made from a smooth and easy to wipe fabric for ease of collecting hair clippings. In this way, the hair clippings can be collected, funneled through a collection channel (to be further discussed herein), and also easily wiped away from the material.

Other materials for use in the system are also hereby contemplated for use. Other material may include, but are not limited to, polyvinyl chloride, other vinyls or a combination of vinyls, mesh fabric, sheath fabric, cloth, wooden materials, polymers, enhanced polymers, an organic fabric, a rubber, a combination of cushioned materials and polymers, a combination of metals, alloys, or other lightweight materials that are easy to maneuver and easy to use and safe, or any other material or combination thereof.

Furthermore, various textile materials are also hereby contemplated for use which might include a canvas, linen material, leathers—hand crafted and the like—, suede and other higher end materials. Additionally, various polymer types which maintain their structural integrity while providing a lightweight structure are also hereby contemplated for use. Furthermore, a combination of these materials is hereby contemplated for use. In the arrangement shown as one example, a textile material is combined with a polymer to form a completely smooth system which provides for varying rigidity but also for a continuous smooth surface for easy cleaning and the like.

Additionally, in the arrangement shown, as one example, the flare features 210 are approximately rectangular and/or square in shape, but may present as a triangle and/or two triangles for folding and other purposes, such as maximizing collection surface area. Additionally, various shapes as may be needed for efficient operation of various grooming methods and collection methods are hereby contemplated for use. Other shapes include, but are not limited to, circular shapes, triangular shapes, bowl like shapes for collection, trapezoidal like shapes which flare and/or take advantage of differentiation in collection methods, and the like.

In the arrangement shown, flare features 210 may include a first panel 212 extending a length from a first end 214 to a second end 216, having a top surface 218 and a bottom surface 220. Additionally, the flare feature 210 may also include attachment features 224, support features and a lip feature, among other components, features, and the like. Additionally, flare features 210 may also include a second panel 230 extending a length from a first end 232 to a second end 234, having a top surface 236 and a bottom surface 238 and a pair of tapered opposing sides 240. Additionally, the second panel 230 may include various attachment features 242, a support feature and a lip feature, among other components and features. Furthermore, flare features 210 may also include additional structural components such as wire or rods, and the like.

Collection System:

In the arrangement shown, as one example, system 10 may also include a collection system 300. Collection system 300 (also referred to as a "disposal system", a "collection device", or simply a "cup") is formed of any suitable size, shape, and design and is configured to collect and/or isolate debris and/or hair trimmings into an isolated area and/or container for easy cleaning.

In the arrangement shown as one example, disposal collection system 300 is formed of a plurality of components which include, but are not limited to, the disposal alleys, the various directional shaped features of system 10, the smooth surfaces of system 10, and the like. Additionally, the disposal system includes alleys for diverting, containers for collecting, and various features which allow for easy cleaning of system 10 and disposal of waste.

In the arrangement shown, as one example, disposal system 300 may include a disposal trap. Disposal trap is formed of any suitable size, shape, and design, and is configured to trap hair trimmings and the like in a particular location within system 10 for easy disposal. Additionally, and in alternative embodiments, disposal trap may also be a description for the disposal alleys which form portions of system 10. Here, in the disposal alleys 302, hair trimmings and the like can be folded and/or rolled into the interior surfaces of system 10 such that the hair trimmings and the like can be easily transported to the outdoors, to trash cans, to sinks and the like, for easy disposal.

Additionally, and in the arrangement shown, as one example, disposal system 300 includes a disposal alley opening, and/or access and/or cover for easy opening to the interior from the exterior for additional means of disposing of the contents, debris and/or hair trimmings trapped within the interior. Other components of the disposal system 300 may include, but are not limited to, a disposal alley funnel and a disposal collection container. Both a removal and a non-removable disposal collection container are hereby contemplated for use with system 10. These and other components, features, and functionality to clean system 10 and/or dispose of waste are hereby contemplated for use, including a wiper for gently cleaning hair and the like from the surfaces of system 10.

Support System:

In the arrangement shown, as one example, system 10 may also include a support system 400. Support system 400 (also referred to as a "rod system", a "skeleton system", or simply "supports") is formed of any suitable size, shape, and design and is configured to provide support to system 10 as a skeletal-like structure of supports. This is one embodiment. In other embodiments, as are shown by some examples, support structures are not needed due to the materials used. Additionally, not all embodiments include a skeleton like support system. Other embodiments may have wired supports and the like, and/or may rely on physical forces from the neck support and the like.

Plurality of Supports: In the arrangement shown, as one example, the support system 400 includes a plurality of supports (or "structure", "bars", or simply "supports"). Plurality of supports are formed of any suitable size, shape, and design and are configured to make up the main structure of the support system 400. In the arrangement shown, as one example, the plurality of supports make up the structure of the support system 400. In the arrangement shown, as one example, the plurality of supports are formed of approximately vertical and approximately horizontal bar-shaped, elongated structures that connect in a frame like pattern such that a stable frame is formed. In this way, the plurality of supports form the support system 400 of system 10 by a plurality of elongated bars and/or rods and connections.

In the arrangement shown, as one example, the plurality of supports are made of individual bars and/or rods and/or plates or individual pieces which are then connected through permanent connection methods or by attaching with fasteners and or adhesives, welding, or any other connection means such as molded extrusion and the like. However, the support system 400 may also be formed of a single unitary construction through a single extrusion, single mould, or the like. In this way, a single, unitary piece is formed. In this way, the support system 400 may be stronger and easier to make and use.

In the arrangement shown, as one example, a plurality of horizontal supports extend outwardly, and perpendicularly to the vertical supports. These horizontal supports may be ground supports which situate against the user 12. In this way, user support are discussed further herein.

In the arrangement shown, as one example, a plurality of vertical supports are connected by a plurality of horizontal supports to form part of the support system 400. However, any other number of supports is hereby contemplated for use. Said another way, the support system 400 may have three vertical supports, four vertical supports, five vertical supports or more vertical supports as appropriate. Said another way, the system 10 may have a single horizontal support, two horizontal supports, three horizontal supports, four horizontal supports, or more horizontal supports. Additionally, and as contemplated earlier herein, the system may be a unitary construction with supports, but may also be a single unitary construction in which the supports are not elongated bars but singular panels of unitary construction and/or extrusion and the like which may be any one of the plurality of materials mentioned herein, or other materials.

Cleaner System:

In the arrangement shown, as one example, system 10 may also include a cleaning system 500. Cleaning system 500 (also referred to as a "wiper system", a "slip system", or simply "wiper") is formed of any suitable size, shape, and design and is configured to provide for easy and efficient cleaning of system 10. In one arrangement, this system includes a unique wipe which collects the hair and other debris by attraction and by smoothly wiping the surfaces of system 10.

Alternative Embodiment

In an alternative embodiment, system 10 may also include an adjustment feature 250. Adjustment feature 250 (also known as "extension feature" or "elongation feature") may be formed of any suitable size, shape, and design and is configured to add length and/or height to the catch feature 120 and/or the front cover 90 of system 10. In this way, the height of the front cover 90 can be increased, as measured from the top of the shoulder covers 60 to the connection point of the catch feature 120 and the front cover 90. Similarly, and in this way, the length of the catch feature 120 can be increased as measured in several directions.

In this way, a user 12 can easily adjust the height of the front cover 90 and the length of the so that the catch feature 120 can be increased and/or decreased as is desired by a user based on the users preferences, size, shape, and/or operational circumstances. The adjustment feature 250 may be formed of a zipper which releases additional material, a telescoping rod, another telescoping feature, an extension rod, a folding feature, a hook and loop component, a loop and tie component, a combination thereof, or other features which can provide suitable extension.

Alternative Embodiment

In an alternative embodiment, system 10 is formed as a unitary construction. In this arrangement, the self supporting beard trimming catcher system 10 is formed as a singular pop out design. In this way, the system 10 is collapsible either through twisting, rolling, folding, or the like. Furthermore, in this way, the "pop out" design can swiftly cause the system 10 to pop open into place and also swiftly fold and/or twist into a closed position which is significantly smaller than an open position, for storage and the like.

In the alternative embodiment, system 10 is formed as a collapsible and/or foldable system. In this way, the unitary construction of system 10 provides for a seamless motion of opening and closing. Similarly, in this way, a user can near instantly unfold and/or open system 10 by light hand pressure. Similarly, in this way, a user can nearly instantly fold and/or close and/or collapse the system 10 by light hand pressure. In this way, system 10 can be easily extended and/or closed. Similarly, this process can be repeated again and again as may be needed by a user.

In this alternative embodiment, system 10 is formed of a plurality of elastic like structures and a stretched and/or material aligned between and/or extended within the structure formed from outer edges. In this way, the outer edges are configured of different sizes and shapes such that the system 10 unfolds and/or opens into a form which sits over the shoulders, lays over the upper chest of a user, and extends perpendicular from the body to configure the catch feature 120 (discussed herein).

Said another way, in this alternative embodiment, system 10 is self-erecting once released from a closed and/or fastened position. In this way, system 10 is formed of a tensile, pop-open structure that has a tensile structure within a vinyl or plastic like material and/or other membrane like material that is placed into tension by the tensile structure system. Said another way, the tensile structure within system 10 forms the structure desired and described in shape within the system 10 herein, while stretching a membrane there between so the membrane can be used to catch beard trimmings and/or hair trimmings.

In this way, the pop-open transition system provides and is configured to provide an easy-to-fold and easy-to-open transition. In the present alternative embodiment, system 10 is formed of a single membrane being extended to form a structure for use over the shoulders of a single person, and shaped to extend perpendicularly from a user so as to catch beard trimmings and the like.

In this alternative embodiment, system 10 is formed and designed to fit over a user's shoulders and extends as a unitary construction downward over the chest of a user and then outward extending perpendicular to a user.

In this alternative embodiment, system 10 may also include a plurality of fasteners 260. Plurality of fasteners 260 are formed of any suitable size, shape, and design and are configured to trap and/or hold system 10 in place even as system 10 is trying to unfold and/or open and/or twist open via the extension structure system configured within system 10. Said another way, the plurality of fasteners 260 provide a quick-release in a convenient location for a user so that a user can fold up system 10 and simply fasten system 10 into place until the next use is needed and/or for ease of transportation, storage, and the like.

In the alternative embodiment, a suitable quick-release fastener 260 comprising a male and female stud or couple may be employed. Similarly, the plurality of fasteners 260 may be formed of a couple. Similarly, the plurality of fasteners 260 may be formed of a hook and loop structure which may include a strap and/or not include a strap. Similarly, the plurality of fasteners 260 may be tucking and/or folding of the main structure of system 10 such that the system 10 does not need additional components but folds and/or tucks into itself and/or an aperture created by folding.

Alternative Embodiment

In an alternative embodiment, system 10 is formed as a construction comprising a foldout system over the shoulders but a pop-out system to extend horizontally from the body of a user. In this arrangement, the self supporting beard trimming catcher system system 10 is formed as a multi-piece design which includes a secondary and/or separate pop-out design forming the catch feature 120. In this way, the catch feature 120 is formed of a pop-out membrane while the remainder of the system is as described herein.

In this way, the catch feature 120 is collapsible either through twisting, rolling, folding, or the like. Furthermore, in this way, the "pop out" design can swiftly cause the system 10 to pop open into place and also swiftly fold and/or twist into a closed position which is significantly smaller than an open position, for storage and the like.

In the alternative embodiment, catch feature 120 is formed as a collapsible and/or foldable system. In this way, the unitary construction of catch feature 120 provides for a seamless motion of opening and closing, in concert with the remainder of system 10, as described herein.

Similarly, in this way, a user can near instantly unfold and/or open catch feature 120 by light hand pressure. Similarly, in this way, a user can nearly instantly fold and/or close and/or collapse the catch feature 120 by light hand pressure. In this way, catch feature 120 can be easily extended and/or closed. Similarly, this process can be repeated again and again as may be needed by a user.

In this alternative embodiment, catch feature 120 is formed of a plurality of elastic like structures and a stretched and/or material aligned between and/or extended within the structure formed from outer edges. In this way, the outer edges are configured of different sizes and shapes such that the catch feature 120 unfolds and/or opens into a form which sits over the shoulders, lays over the upper chest of a user, and extends perpendicular from the body to configure the catch feature 120 (discussed herein).

Said another way, in this alternative embodiment, catch feature 120 is self-erecting once released from a closed and/or fastened position. In this way, catch feature 120 is formed of a tensile, pop-open structure that has a tensile structure within a vinyl or plastic like material and/or other membrane like material that is placed into tension by the tensile structure system. Said another way, the tensile structure within catch feature 120 forms the structure desired and described in shape within the catch feature 120 herein, while stretching a membrane there between so the membrane can be used to catch beard trimmings and/or hair trimmings.

In this way, the pop-open transition system provides and is configured to provide an easy-to-fold and easy-to-open transition. In the present alternative embodiment, catch feature 120 in concert with the rest of system 10 is formed of a single membrane and fold out system being extended to form a structure for use over the shoulders of a single person, and shaped to extend perpendicularly from a user so as to catch beard trimmings and the like.

In this alternative embodiment, catch feature 120 in concert with the rest of system 10 is formed and designed to fit over a user's shoulders and extends as a unitary construction downward over the chest of a user and then outward extending perpendicular to a user.

In this alternative embodiment, system 10 may also include a plurality of fasteners 260. Plurality of fasteners 260 are formed of any suitable size, shape, and design and are configured to trap and/or hold system 10 in place even as system 10 is trying to unfold and/or open and/or twist open via the extension structure system configured within system 10. Said another way, the plurality of fasteners 260 provide a quick-release in a convenient location for a user so that a user can fold up system 10 and simply fasten system 10 into place until the next use is needed and/or for ease of transportation, storage, and the like.

In the alternative embodiment, a suitable quick-release fastener 260 comprising a male and female stud or couple may be employed. Similarly, the plurality of fasteners 260 may be formed of a couple. Similarly, the plurality of fasteners 260 may be formed of a hook and loop structure which may include a strap and/or not include a strap. Similarly, the plurality of fasteners 260 may be tucking and/or folding of the main structure of system 10 such that the system 10 does not need additional components but folds and/or tucks into itself and/or an aperture created by folding.

While this alternative embodiment contemplates catch feature 120 as a pop-out structure in concert with other features of system 10. System 10 may also be formed of a plurality of pop-out structures. In this way, back cover 20 may also be a pop-out feature, over shoulder feature 60 may also be a separate pop-out feature. In this way, front cover 90 may also be a pop-out feature. In this way, flare features 210 may also be pop-out features.

Said another way, system 10 may be of a unitary construction or a non-unitary construction. In a unitary construction and as an alternative embodiment, system 10 is a single pop-out structure. Similarly, and as an alternative embodiment, any one or more of the structures of system 10 may be formed as a pop-out feature as part of the larger plurality of structures of system 10. These and other embodiments are hereby contemplated for use.

In Operation/Methods of Use:

In the arrangement shown, as one example, a user can easily and efficiently employ the systems disclosed herein in various methods and uses to create a very clean and efficient hair trimming and body grooming environment. The system is a stand alone and self supportive system. These systems and the various uses are hereby contemplated for use. The disclosure herein also considered methods of using these systems and features.

In one arrangement, and as is shown, in one example, the system causes debris to slide directly from the first panel and/or second panel and/or third panel and/or fourth panel directly into the disposal alley. The material coating is relatively smooth and when the catch feature is set up, the panels are angled due to the sizing of the framing and/or suspension features and/or material constraints. In this way, the angled panels, in concert with gravity, cause debris and/or most debris to slide into the disposal alley. In this way, the debris can be easily dumped from the disposal alley and/or grabbed in the disposal alley. In this way, there is no need for a wipe and/or other cleaning apparatus.

Additionally, and in alternative embodiments the personal mobility system may be used with other systems, and may incorporate other systems therein.

It will be appreciated by those skilled in the art that other various modifications could be made to the systems without parting from the spirit and scope of this disclosure. All such modifications and changes fall within the scope of the claims and are intended to be covered thereby.

What is claimed:

1. A grooming system, comprising:
a back cover;
the back cover having a first back cover extending a length from a first end to a second end;
the back cover having an interior surface and an exterior surface;
an over shoulder feature;
the over shoulder feature having a first shoulder cover extending a length from a first end to a second end;
the first shoulder cover having a pocket feature for storage;
the over shoulder feature having a second shoulder cover extending a length from a first end to a second end;
the second shoulder feature having a pocket feature;
the over shoulder feature having a connection feature;
the over shoulder feature having a plurality of attachment features;
a front cover;
the front cover having a first panel;
the first panel extending a length from a first end to a second end between opposing sides;
the first panel having a front surface;
the first panel being relatively smooth on the front surface;
a catch feature;
the catch feature having a first panel;
the first panel extending a length from a first end to a second end between opposing sides;
the first panel having a top surface;
the first panel being relatively smooth on the top surface;
wherein the catch feature is configured to extend in approximate perpendicular spaced relation to the front cover;
wherein the closed position is when the catch feature is folded into the front cover for storage;
wherein the open position is when the catch feature is extending in approximate perpendicular spaced relation to the front cover;
a suspension catch feature:
wherein the suspension catch feature is formed from a triangular shaped material attached to the front cover and the catch feature such that the triangular shaped material is placed in tension when the catch feature is extended away from the front cover to an open position:
wherein the triangular shaped material is folded into a position of compression when the catch feature is folded against the front cover:
wherein the suspension catch feature causes hair trimmings to be caught.

2. The system of claim 1, further comprising:
the first back cover having a pocket feature for storage.

3. The system of claim 1, further comprising:
the back cover having a second back cover extending a length from a first end to a second end;
the second back cover having an interior surface and an exterior surface.

4. The system of claim 1, further comprising:
the back cover having a second back cover extending a length from a first end to a second end;
the second back cover having an interior surface and an exterior surface;
the second back cover having a pocket feature;
wherein the pocket feature of the second back cover provides storage.

5. The system of claim 1, further comprising:
the back cover having a connection feature;
the back cover having a plurality of attachment features.

6. The system of claim 1, further comprising:
the first panel having a pocket feature;
the first panel operably connected to a disposal system.

7. The system of claim 1, further comprising:
the front cover having a second panel;
the second panel extending a length from a first end to a second end between opposing sides;
the second panel having a front surface and a bottom;
the second panel being relatively smooth on the front surface;
the second panel operably connected to the disposal system.

8. The system of claim 1, further comprising:
the front cover having a second panel;
the second panel extending a length from a first end to a second end between opposing sides;

the second panel having a front surface and a bottom;
the second panel being relatively smooth on the front surface;
the second panel having a pocket feature.

9. The system of claim 1, further comprising:
the first panel having a pocket feature;
the first panel operably connected to the disposal system.

10. The system of claim 1, further comprising:
a structural frame.

11. The system of claim 1, further comprising:
the front cover having a structural frame built into the front cover;
the catch feature having a structural frame;
wherein the catch feature is supported in this spaced relation by the structural frame, built into the catch feature, and the structural frame built into the front cover;
wherein the catch feature is configured to move into a closed position by twisting the structural frame into a position of tension;
wherein the catch feature is configured to move into an open position by releasing the structural frame from a position of tension.

12. The system of claim 1, further comprising:
a plurality of flare features;
the plurality of flare features each having a catching surface;
the catching surface extending a length from a first end to a second end between a tapering opposing side;
the catching surface having a top surface;
the catching surface being relatively smooth on the top surface;
each of the plurality of flare features having a lip feature.

13. The system of claim 1, further comprising:
a plurality of adjustment features;
wherein each of the adjustment features operably provides for raising and lowering the catch feature and the plurality of flare features;
wherein the back cover has adjustment features which allow for tightening or loosening the back cover.

14. The system of claim 1, further comprising:
a disposal system;
wherein the disposal system includes a removable catch;
wherein the removable catch collects debris;
wherein debris can be wiped into the removable catch from various surfaces.

15. The system of claim 1, further comprising:
a suspension catch feature;
the suspension catch feature having a plurality of wires which are connected to the front cover and the catch feature;
wherein the suspension catch feature provides for the catch feature to be lowered and held in place by the plurality of wires.

16. A grooming system, comprising:
an over shoulder feature;
the over shoulder feature having a connection feature;
a front cover;
the front cover having a first panel:
the first panel extending a length from a first end to a second end between opposing sides:
the first panel having a front surface;
the first panel being relatively smooth on the front surface;
a catch feature;
the catch feature having a first panel:
the first panel extending a length from a first end to a second end between opposing sides:
the first panel having a top surface;
the first panel being relatively smooth on the top surface;
wherein the catch feature is configured to extend in approximate perpendicular spaced relation to the front cover;
wherein the closed position is when the catch feature is folded into the front cover for storage;
wherein the open position is when the catch feature is extending in approximate perpendicular spaced relation to the front cover;
a suspension catch feature;
wherein the suspension catch feature is formed from a triangular shaped material attached to the front cover and the catch feature, such that the triangular shaped material is placed in tension when the catch feature is extended away from the front cover to an open position;
wherein the triangular shaped material is folded into a position of compression when the catch feature is folded against the front cover;
wherein the suspension catch feature causes hair trimmings to be caught.

17. A grooming collection system, comprising:
a back cover;
the back cover having a first back cover extending a length from a first end to a second end;
the back cover having an interior surface and an exterior surface;
the first back cover having a pocket feature for storage;
the back cover having a second back cover extending a length from a first end to a second end;
the second back cover having an interior surface and an exterior surface;
the second back cover having a pocket feature;
wherein the pocket feature of the second back cover provides storage;
the back cover having a connection feature;
the back cover having a plurality of attachment features;
an over shoulder feature;
the over shoulder feature having a first shoulder cover extending a length from a first end to a second end;
the first shoulder cover having a pocket feature for storage;
the over shoulder feature having a second shoulder cover extending a length from a first end to a second end;
the second shoulder feature having a pocket feature;
the over shoulder feature having a connection feature;
the over shoulder feature having a plurality of attachment features;
a front cover;
the front cover having a first panel;
the first panel extending a length from a first end to a second end between opposing sides;
the first panel having a front surface;
the first panel being relatively smooth on the front surface;
the first panel having a pocket feature;
the first panel operably connected to a disposal system;

the front cover having a second panel;

the second panel extending a length from a first end to a second end between opposing sides;

the second panel having a front surface and a bottom;

the second panel being relatively smooth on the front surface;

the second panel having a pocket feature;

the second panel operably connected to the disposal system;

the front cover having a structural frame built into the front cover;

the front cover having a plurality of attachment features;

a catch feature;

the catch feature having a first panel;

the first panel extending a length from a first end to a second end between opposing sides;

the first panel having a top surface;

the first panel being relatively smooth on the top surface;

the first panel having a pocket feature;

the first panel operably connected to the disposal system;

the front cover having a second panel;

the second panel extending a length from a first end to a second end between opposing sides;

the second panel having a top surface and a bottom;

the second panel being relatively smooth on the top surface;

the second panel having a pocket feature;

the second panel operably connected to the disposal system;

the catch feature having a structural frame built into the catch feature;

the front cover having a plurality of attachment features;

wherein the catch feature is configured to extend in approximate perpendicular spaced relation to the front cover;

wherein the catch feature is supported in this spaced relation by the structural frame built into the catch feature and the structural frame built into the front cover;

wherein the catch feature is configured to move into a closed position by twisting the structural frame into a position of tension;

wherein the catch feature is configured to move into an open position by releasing the structural frame from a position of tension;

wherein the closed position is when the catch feature is folded into the front cover for storage;

wherein the open position is when the catch feature is extending in approximate perpendicular spaced relation to the front cover;

a plurality of flare features;

the plurality of flare features each having a catching surface;

the catching surface extending a length from a first end to a second end between a tapering opposing side;

the catching surface having a top surface;

the catching surface being relatively smooth on the top surface;

each of the plurality of flare features having a lip feature;

a plurality of adjustment features;

wherein each of the adjustment features operably provides for raising and lowering the catch feature and the plurality of flare features;

wherein the back cover has adjustment features which allow for tightening or loosening the back cover;

a plurality of fasteners configured to provide a quick-release to fold the grooming collection system;

a suspension catch feature:

wherein the suspension catch feature is formed from a triangular shaped material attached to the front cover and the catch feature, such that the triangular shaped material is placed in tension when the catch feature is extended away from the front cover to an open position;

wherein the triangular shaped material is folded into a position of compression when the catch feature is folded against the front cover;

wherein the suspension catch feature causes hair trimmings to be caught.

18. The system of claim 17, further comprising:

a wiper.

* * * * *